US007933529B2

(12) United States Patent
Nakamura et al.

(10) Patent No.: US 7,933,529 B2
(45) Date of Patent: Apr. 26, 2011

(54) IMAGE FORMING APPARATUS, METHOD FOR CONTROLLING IMAGE FORMING APPARATUS, FIXING APPARATUS

(75) Inventors: Kei Nakamura, Tokyo (JP); Nobuyuki Satoh, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 162 days.

(21) Appl. No.: 11/507,673

(22) Filed: Aug. 22, 2006

(65) Prior Publication Data

US 2007/0047989 A1 Mar. 1, 2007

(30) Foreign Application Priority Data

Aug. 30, 2005 (JP) ..... 2005-248661
Sep. 16, 2005 (JP) ..... 2005-269704
Nov. 1, 2005 (JP) ..... 2005-318889

(51) Int. Cl.
*G03G 15/20* (2006.01)

(52) U.S. Cl. ..... 399/69; 399/328

(58) Field of Classification Search ..... 399/69; 219/216

See application file for complete search history.

(56) References Cited

U.S. PATENT DOCUMENTS 7,002,112 B2 2/2006 Kishi et al.
7,054,570 B2 5/2006 Kishi et al.
7,116,923 B2 * 10/2006 Kishi et al. ..... 399/69
7,130,555 B2 10/2006 Kishi et al.
7,209,675 B2 4/2007 Matsusaka et al.
7,212,759 B2 5/2007 Kishi et al.
7,239,821 B2 7/2007 Matsusaka et al.
7,308,216 B2 12/2007 Kishi et al.
7,359,653 B2 4/2008 Okamoto
7,551,869 B2 6/2009 Kishi et al.
7,603,049 B2 10/2009 Kishi et al.
7,609,988 B2 10/2009 Kishi et al.
2003/0230561 A1 12/2003 Kagawa et al. ..... 219/216
2004/0028420 A1 2/2004 Aslam et al. ..... 399/45
2004/0245235 A1 * 12/2004 Kishi et al. ..... 219/216
2005/0013626 A1 1/2005 Satoh et al. ..... 399/81
2005/0123315 A1 6/2005 Kishi et al.
2006/0039713 A1 * 2/2006 Kishi et al. ..... 399/69
2006/0051120 A1 * 3/2006 Kishi et al. ..... 399/69

FOREIGN PATENT DOCUMENTS

EP 1 376 261 A1 1/2004

(Continued)

OTHER PUBLICATIONS

U.S. Appl. No. 11/936,444, filed Nov. 7, 2007, Nakamura.

(Continued)

*Primary Examiner* — David M Gray
*Assistant Examiner* — Andrew V Do
(74) *Attorney, Agent, or Firm* — Oblon, Spivak, McClelland, Maier & Neustadt, L.L.P.

(57) ABSTRACT

An image forming apparatus includes a fixing apparatus for fixing a toner image onto a recording medium by applying pressure and heat to toner provided on the surface of the recording medium. The fixing apparatus includes a fixing member, a pressing member for pressing against the fixing member, a temperature detecting part for detecting the temperature of the fixing member, and a heating member including a main heating member and an auxiliary heating member for heating the fixing member, the main heating member being heated by obtaining power from a main power supply, the auxiliary heating member being heated by obtaining power from an auxiliary power supply.

12 Claims, 24 Drawing Sheets

FOREIGN PATENT DOCUMENTS

| | | | | |
|---|---|---|---|---|
| EP | 1 531 370 | A1 | | 5/2005 |
| EP | 1 542 085 | A1 | | 6/2005 |
| JP | 03-005779 | | | 1/1991 |
| JP | 5-323826 | | | 12/1993 |
| JP | 6-4005 | | | 1/1994 |
| JP | 8-220928 | | | 8/1996 |
| JP | 2001-92295 | | | 4/2001 |
| JP | 2001-154525 | | | 6/2001 |
| JP | 2001-282041 | | | 10/2001 |
| JP | 2002-14574 | | | 1/2002 |
| JP | 2002-184554 | | | 6/2002 |
| JP | 2002-189380 | | | 7/2002 |
| JP | 2002-365968 | | | 12/2002 |
| JP | 2003270980 | A | * | 9/2003 |
| JP | 2004-71261 | | | 3/2004 |
| JP | 2004-95525 | | | 3/2004 |
| JP | 2004-286869 | | | 10/2004 |
| JP | 2004-296292 | | | 10/2004 |
| JP | 2005-18049 | | | 1/2005 |
| JP | 2005-32558 | | | 2/2005 |
| JP | 2005-39873 | | | 2/2005 |
| JP | 2005-166633 | | | 6/2005 |
| JP | 2005-174577 | | | 6/2005 |
| JP | 2005-216786 | | | 8/2005 |
| JP | 4031718 | | | 10/2007 |

OTHER PUBLICATIONS

Office Action issued Aug. 27, 2010, in Japan Patent Application No. 2005-269704.

Office Action issued Feb. 15, 2011, in Japanese Patent Application No. 2005-269704, filed Sep. 16, 2005.

* cited by examiner

IMAGE FORMING APPARATUS, METHOD FOR CONTROLLING IMAGE FORMING APPARATUS, FIXING APPARATUS

BACKGROUND OF THE INVENTION

1. Field of the Invention

The present invention relates to a fixing apparatus for fixing a toner image onto a recording medium, an image forming apparatus including the fixing apparatus, and a method for controlling the image forming apparatus, and more particularly, a fixing apparatus, an image forming apparatus (e.g. a copier, a digital multi-function machine, a printer), and a method for controlling the image forming apparatus for fixing a toner image onto a recording medium such as roll paper, long paper having a length greater than standard size paper, wide paper having a width greater than standard size paper.

2. Description of the Related Art

Image forming apparatuses such as copiers and printers form images on recording media such as plain paper and OHP (Over Head Projector) sheets. In forming the images, an electrophotographic method is widely used for attaining satisfactory image forming speed, image quality, and cost. In using the electrophotographic method, a toner image is formed on a recording medium, and is then fixed onto the recording medium by applying thermal pressure thereto. A heat roll method is currently the most commonly used fixing method from the aspects of, for example, safety. In using the heat roll method, a cooperative pressing part (also referred to as a nipping part) including a fixing roller heated by a heating member (e.g. a halogen heater) and a pressing roller facing the heating roller is formed so that the toner image transferred onto the recording medium can be heated by the nipping part.

In recent years, image forming apparatuses, which can form images on long length paper such as roll paper or long paper having a length longer than standard size paper, have been introduced. In a case of forming images on long length paper, a fixing roller having a large heat capacity is required owing to the fact that the heat required for fixing an image onto the recording medium is continuously absorbed for a long period. However, the use of a fixing roller having a large heat capacity increases the time required for initiating the process of conveying the recording medium through the nipping part (rise time). Conventionally, in order to prevent this problem, an auxiliary heating part is disposed inside the fixing roller and a comparatively large amount of power is supplied to the auxiliary heating part at the early stages of the rise by using a rechargeable auxiliary power supply, so that the fixing roller can be heated without requiring a large heat capacity and the time required for initiating the process of conveying the recording medium through the nipping part (rise time) can be shortened.

For example, Japanese Laid-Open Patent Application No. 2002-14574 discloses an image forming apparatus having plural heating parts provided to a fixing roller for driving the heating parts during a period of rising temperature from a standby state and generating a large amount of power.

In another example, Japanese Laid-Open Patent Application No. 2004-286869 discloses an image forming apparatus having a large capacity capacitor serving as the auxiliary power supply of a fixing roller and efficiently charging the capacitor by detecting the charge voltage of the capacitor.

In another example, Japanese Laid-Open Patent Application No. 2005-32558 discloses an image forming apparatus that controls the power supplied to an auxiliary heating part based on the charge voltage of a capacitor and the temperature of a fixing roller for providing a sufficient amount of power to the auxiliary heating part while preventing the supplied power from adversely affecting the circuits surrounding the auxiliary heating part.

In another example, Japanese Laid-Open Patent Application No. 2005-18049 discloses an image forming apparatus that controls a charging operation of a capacitor and an image forming job for minimizing the time for completing the image forming job (including the time for executing a copying job and the time for charging the capacitor).

However, even if the rise time for initiating the process of conveying the recording medium through the nipping part is shortened by using the above-described auxiliary power supply, an image cannot be sufficiently fixed onto a long recording medium as long as a fixing roller (fixing member) having a small thermal capacity is used owing to the fact that the temperature of the fixing roller drops below the temperature required by the fixing roller to fix the image onto the recording medium. This results in poor fixing quality.

Furthermore, in a case where a fixing member having a large thermal capacity is used, a long period of time is required for heating the fixing member to a temperature sufficient for fixing a toner image onto a recording medium. As a result, a long period of time is required for starting a fixing operation.

Japanese Laid-Open Patent Application No. 6-4005 discloses an image forming apparatus having a determining part for determining whether the conveyed recording medium is long paper that is greater in length than standard size paper. According to the determination results of the determining part, the number of heaters that are lit on/off is controlled.

However, since this method determines whether the heaters are to be turned on and off based on merely the size of the recording medium, too much heat may be supplied to the fixing roller where the fixing roller is already heated to a sufficient temperature. As a result, a stable fixing performance cannot be attained.

Japanese Laid-Open Patent Application No. 8-220928 discloses an image forming apparatus that prevents deterioration of image quality due to the drop of fixing temperature when passing a long recording medium through a nipping part by changing the fixing conditions according to paper size, paper thickness, and surface characteristics.

This method determines the heating conditions of the fixing roller based on merely the characteristics of the target recording medium. However, fixing quality also depends on, for example, heating conditions of the fixing roller that differ based on the characteristics of toner or its environment. Therefore, it is difficult to constantly attain satisfactory results by using this method.

Other related examples showing a configuration of an image forming apparatus including a fixing apparatus are disclosed in Japanese Laid-Open Patent Application Nos. 2001-092295, 2001-154525, 2002-184554, and 2005-39873.

SUMMARY OF THE INVENTION

The present invention may provide an image forming apparatus, a method for controlling an image forming apparatus, and a fixing apparatus that substantially obviates one or more of the problems caused by the limitations and disadvantages of the related art.

Features and advantages of the present invention are set forth in the description which follows, and in part will become apparent from the description and the accompanying drawings, or may be learned by practice of the invention according to the teachings provided in the description. Objects as well as other features and advantages of the present invention will be realized and attained by an image forming apparatus, a method for controlling an image forming apparatus, and a fixing apparatus particularly pointed out in the specification in such full, clear, concise, and exact terms as to enable a person having ordinary skill in the art to practice the invention.

To achieve these and other advantages and in accordance with the purpose of the invention, as embodied and broadly described herein, an embodiment of the present invention provides an image forming apparatus including a fixing apparatus for fixing a toner image onto a recording medium by applying pressure and heat to toner provided on the surface of the recording medium, the fixing apparatus including: a fixing member; a pressing member for pressing against the fixing member; a temperature detecting part for detecting the temperature of the fixing member; and a heating member including a main heating member and an auxiliary heating member for heating the fixing member, the main heating member being heated by obtaining power from a main power supply, the auxiliary heating member being heated by obtaining power from an auxiliary power supply.

In the image forming apparatus according to an embodiment of the present invention, the auxiliary heating member may be heated when the temperature detecting part detects that the temperature of the fixing member is no greater than a threshold fixation temperature during the operation of fixing the toner image onto the recording medium.

In the image forming apparatus according to an embodiment of the present invention, the image forming apparatus may further include: a calculating part for calculating a tilt of the changes of the temperature of the fixing roller temperature; and an auxiliary power supply controlling part for controlling electric connections of a plurality of auxiliary power supply units included in the auxiliary power supply; wherein the plural auxiliary power supply units can be switched between parallel connection and serial connection, wherein in a case where the temperature of the fixing member is no greater than the threshold fixation temperature, the auxiliary power supply controlling part switches the electric connection of the plural auxiliary power supply units to serial connection when an absolute value of the tilt calculated by the calculating part is no less than a predetermined threshold tilt and switches the electric connection of the plural auxiliary power supply units to parallel connection when the absolute value of the tilt calculated by the calculating part is less than the predetermined threshold tilt.

In the image forming apparatus according to an embodiment of the present invention, the auxiliary power supply may include an electric double layer capacitor which is chargeable and dischargeable, wherein the electric double layer capacitor is charged when no power is being supplied from the main power supply to the main heating member.

In the image forming apparatus according to an embodiment of the present invention, the auxiliary power supply may include a fuel cell that can be reused by refueling.

In the image forming apparatus according to an embodiment of the present invention, the fuel cell may include a part for detecting the amount of fuel remaining in the fuel cell, a part displaying the remaining amount of fuel, and a part for requesting the refueling of fuel when the remaining amount of fuel is below a predetermined value.

In the image forming apparatus according to an embodiment of the present invention, the image forming apparatus may further include: a determining part for determining whether a predetermined condition is satisfied for fixing the toner image onto the recording medium by referring to the temperature detected by the temperature detecting part.

In the image forming apparatus according to an embodiment of the present invention, the predetermined condition may include a toner fixation temperature which varies depending on the characteristic of the toner.

In the image forming apparatus according to an embodiment of the present invention, the predetermined condition may include a fixation heat quantity which varies depending on the characteristic of the toner.

In the image forming apparatus according to an embodiment of the present invention, the predetermined condition may include a total fixation heat quantity which varies depending on the characteristic of the recording medium.

In the image forming apparatus according to an embodiment of the present invention, the predetermined condition may include at least one of a toner fixation temperature, a fixation heat quantity, and a total fixation heat quantity.

Furthermore, a method for controlling an image forming apparatus including a fixing apparatus for fixing a toner image onto a recording medium by applying pressure and heat to toner provided on the surface of the recording medium, the fixing apparatus having a fixing member, a pressing member for pressing against the fixing member, a temperature detecting part for detecting the temperature of the fixing member, a heating member including a main heating member and an auxiliary heating member for heating the fixing member, and a nip width adjusting part for adjusting the width of a nipping part between the fixing member and the pressing member, the method including the steps of: a) heating the fixing member with the main heating member to a predetermined temperature; b) conveying a recording medium between the fixing member and the pressing member; c) heating the fixing member with the main heating member and the auxiliary heating member for a predetermined period; and d) increasing the width of the nipping part.

In the method for controlling an image forming apparatus according to an embodiment of the present invention, when the temperature difference between the fixing member and the pressing member is no less than a predetermined temperature, step c) may be executed before executing step d).

In the method for controlling an image forming apparatus according to an embodiment of the present invention, when the recording medium has a length greater than that of standard size paper, steps c) and d) are executed.

In the method for controlling an image forming apparatus according to an embodiment of the present invention, the width of the nipping part may be increased step by step when the temperature detected by the temperature detecting part is insufficient with respect to the predetermined temperature.

In the method for controlling an image forming apparatus according to an embodiment of the present invention, the main heating member and the auxiliary heating member may be used together for heating the fixing member to the predetermined temperature.

Furthermore, the present invention provides a fixing apparatus for fixing a toner image onto a recording medium by applying pressure and heat to toner provided on the surface of the recording medium, the fixing apparatus including: a fixing member; a pressing member for pressing against the fixing member; a temperature detecting part for detecting the temperature of the fixing member; and a heating member including a main heating member and an auxiliary heating member for heating the fixing member, the main heating member being heated by obtaining power from a main power supply, the auxiliary heating member being heated by obtaining power from an auxiliary power supply.

Other objects and further features of the present invention will be apparent from the following detailed description when read in conjunction with the accompanying drawings.

DESCRIPTION OF THE PREFERRED EMBODIMENTS

In the following, embodiments of the present invention will be described with reference to the accompanying drawings.

First Embodiment

Figure 1:
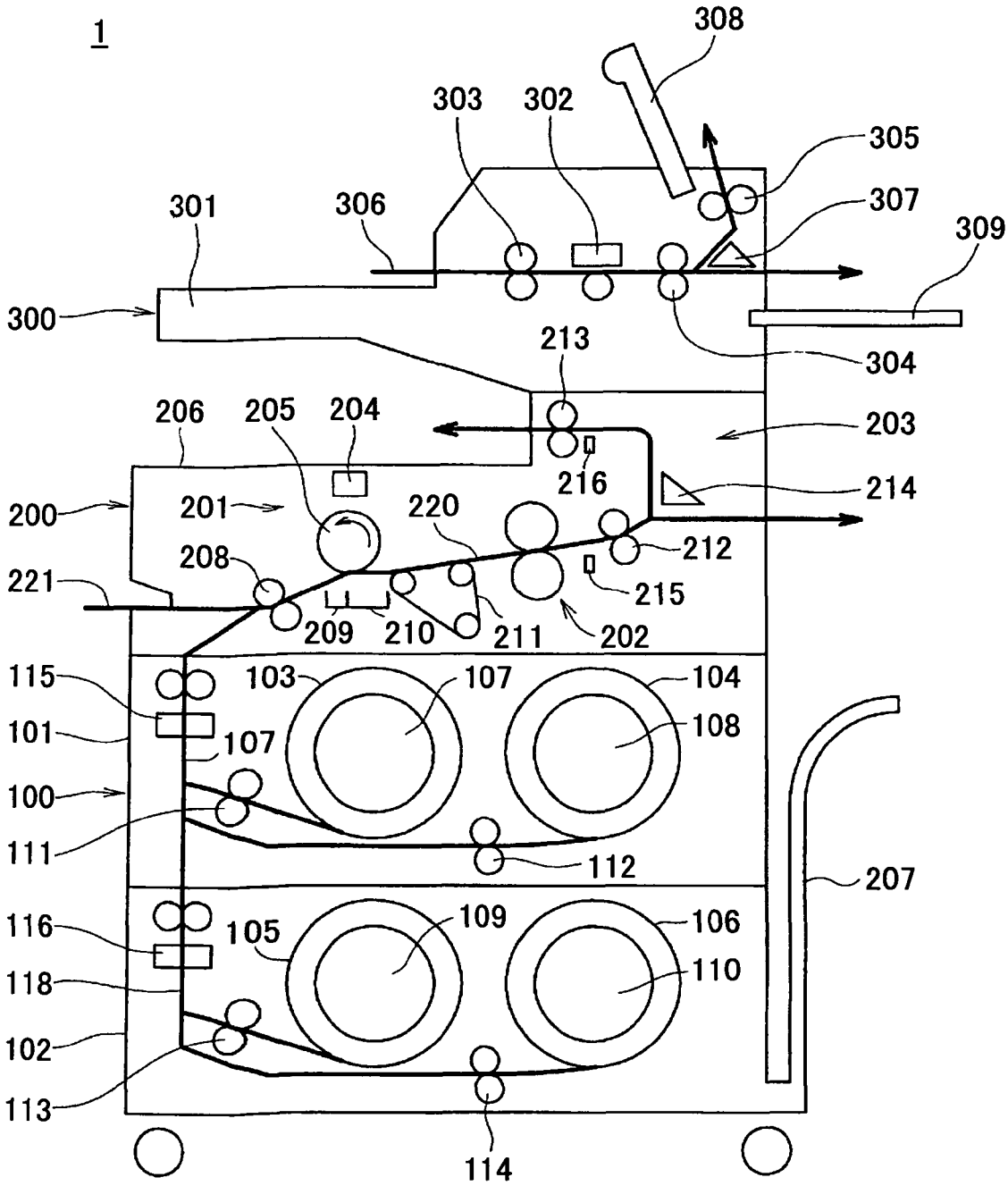
FIG. 1 is a schematic cross-sectional view of an image forming apparatus according to an embodiment of the present invention.

FIG. 1 is a schematic cross-sectional view of an image forming apparatus 1 including, for example, a copier, printer apparatus, a facsimile machine, a multi-function machine including the functions of the foregoing apparatuses (e.g. electrophotographic type multi-function machine) according to an embodiment of the present invention. The image forming apparatus 1 according to this embodiment of the present invention is configured to form images on a recording medium (transfer sheet) P, particularly, on long length paper (e.g. roll paper, long paper having a length greater than standard size paper) and wide paper. In FIG. 1, the image forming apparatus 1 includes an image forming part 200 provided at an upper portion of a sheet feeding part 100, and a reading part (scanner part) 300 provided at an upper portion of the image forming part 200.

An original document(s), which is placed on an original document table 301 of the reading part 300, is fed sheet by sheet to the reading part 300. A contact image sensor (CIS) 302 of the reading part 300 reads an image on the original document. Then, the original document is discharged onto a discharge tray after the image is read. More specifically, first, the original document is placed on the original document table 301 having its sides adjusted by a side fence (not shown) and is conveyed to a position below the contact image sensor 302 by a sheet feeding roller 303. An original document width detecting sensor (not shown) and an original document length detecting sensor (not shown) are mounted on the original document table 301. The two sensors detect the size of the original document delivered from the original document table 301. The original document placed below the contact image sensor 302 is irradiated with light from a light source (e.g. LED array, fluorescent light tubes). The light reflected from the original document is passed through a rod lens array, gathered to the close image sensor 302, and converted into electric signals (photoelectric conversion). After an image is read from the original document, the original document may be discharged to a discharge tray situated on a rear side of the main body of the image forming apparatus 1 by a conveying roller 304 or to a discharge tray situated on an upper portion of the main body of the image forming apparatus 1 by a discharge roller 305.

The image forming part 200 includes an imaging part 201, a fixing part (fixing apparatus) 202, and a sheet discharging part 203. The image forming part 200 processes (forms) the image according to the image signal read and converted (photoelectric conversion) by the close image sensor 302. An LED writing part 204 forms an electrostatic latent image of the read image onto the photoconductor 205 that is uniformly charged by a charging part. The image forming part 200 forms a copy (duplicate) of the original document on a recording medium P fed from the sheet feeding part 100. Then, the sheet discharging part 203 discharges the recording medium P to a discharge tray 206 situated at an upper surface of the image forming part 200 or to a discharge tray 207 situated a rear portion of the image forming part 200.

The sheet feeding part 100 has two roll paper trays 101 and 102 disposed one on top of the other. The roll paper trays 101, 102 can be pulled out (to the left side in FIG. 1) from the housing of the image forming apparatus 1 for allowing roll paper to be placed therein or for correcting the position of roll paper when paper is jammed therein. Two rolls of paper can be set in each of the roll paper trays 101, 102. The paper rolls 103-106, which are wound around paper cores, are held in the sheet feeding part 100 via corresponding paper holders 107-110. Sheet feeding rollers 111-114 are situated in the vicinity of their corresponding rolls of paper 103-106. The roll paper fed from respective sheet feeding rollers 111-114 is cut into a predetermined length by a roll cutting unit 115, 116 provided at a front side of the roll paper tray (left side in FIG. 1), and is delivered to the image forming part 200.

A resist roller 208 guides the delivered roll paper to the photoconductor 205 in synchronization with the timing for imaging. Then, the image formed on the photoconductor 205 is transferred onto the roll paper by a transferring part 209 and is separated from the photoconductor 205 by a separating part 210. Then, the roll paper is guided to the fixing part 202 by a conveyor belt 211. Then, the fixing part 202 thermally fixes the image onto the roll paper. The roll paper having the image fixed thereon is discharged from sheet discharge rollers 212, 213 of the sheet discharging part 203. The direction for discharging the roll paper is switched by a branching nail 214 so that the roll paper can be discharged to the discharge tray 206 or to the discharge tray 207. A sheet discharge sensor 215 is provided between the fixing part 202 and the sheet discharging roller 212, and another sheet discharge sensor 216 is provided between the sheet discharge roller 212 and the sheet discharge roller 213. Thereby, the sheet discharge sensors 215, 216 determine whether roll paper is situated in the sheet discharge part 203. Although not shown in the drawings, the image forming part 200 includes a drive control part for driving the sheet discharge rollers 212, 213, and the reading part 300 includes an operating part (e.g. control panel) for directing, for example, initiation of a reading operation, execution of a repeat copying process, and inputting data regarding the paper roll or long paper.

Figure 2:
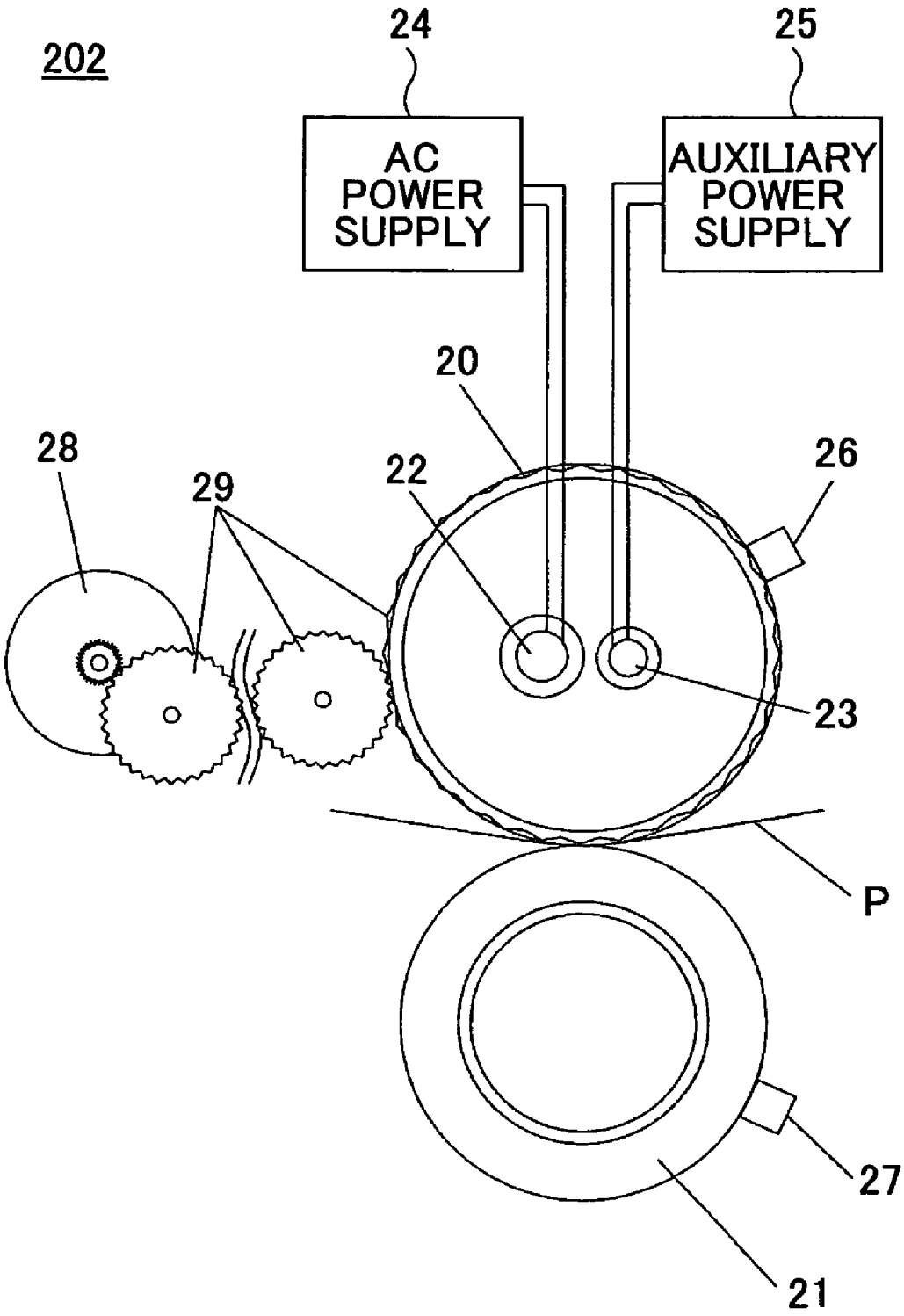
FIG. 2 is a schematic enlarged cross-sectional view of a fixing part (fixing apparatus) according to an embodiment of the present invention.

FIG. 2 is a schematic enlarged cross-sectional view of the fixing part 202 shown in FIG. 1. FIG. 2 shows a fixing roller (fixing member) 20, a pressing roller (pressing member) 21 situated opposite to the fixing roller 20, a main heater (main heating member) 22, an auxiliary heater (auxiliary heating member) 23 disposed inside the fixing roller 20, an AC power supply 24 serving as an external power supply for supplying power to the main heater 22, an auxiliary power supply 25 for supplying power to the auxiliary heater 23, temperature detecting parts 26, 27 for detecting the temperatures of the surface of the fixing roller 20 and the surface of the pressing roller 21, an electromagnetic motor 28 (preferably a servo motor) for providing a rotational driving force to the fixing roller 20, and intermediary gears 29 for transmitting the rotational driving force of the electromagnetic motor 28 to the fixing roller 20.

The fixing roller 20 according to an embodiment of the present invention includes a cylindrical metal pipe having a releasing layer formed thereon. The main and auxiliary heaters 22, 23, which are provided inside the fixing roller 20 in the longitudinal direction, heat the fixing roller 20 to a predetermined temperature. The fixing roller 20 may preferably include a cylindrical aluminum pipe or a cylindrical carbon steel pipe having, for example, a releasing layer (e.g. silicon resin layer, Teflon (trademark) layer) formed thereon. The pressing roller 21 includes a metal pipe having a rubber layer and a releasing layer formed thereon. The pressing roller 21 applies a pressing force to the fixing roller 20. The pressing roller 21 may preferably include a solid cylindrical aluminum pipe or a carbon steel pipe having a rubber layer (e.g. silicone rubber layer) surrounding the pipe and a releasing layer (e.g. silicon resin tube, Teflon (trademark) tube) provided on the surface of the rubber layer. The electromagnetic motor 28 transmits a rotational driving force to the fixing roller 20 and the pressing roller 21 via the intermediary gears 29. Accordingly, the fixing roller 20 and the pressing roller 21 rotate and apply heat and pressure to a recording medium P conveyed through a nipping part between the fixing roller 20 and the pressing roller 21. Thereby, an unfixed toner image on the surface of the recording medium P is fixed to the recording medium P. The main heater 22 and the auxiliary heater 23 are controlled based on the control conditions calculated according to the surface temperatures of the fixing roller 20 and the pressing roller 21 detected by the temperature detecting parts 26, 27. Thereby, the surface temperature of the fixing roller 20 can be controlled to a temperature suitable for fixing the image on the recording medium P.

The heat of the main heater 22 is generated from the power supplied from the AC power supply 24. The heat of the auxiliary heater 23 is generated from the power supplied from the auxiliary power supply 25 which is chargeable and dischargeable. The main heater 22 and the auxiliary heater 23 may preferably include a halogen heater, a nichrome wire heater, or an IH (Induction Heating) heater. The electromagnetic motor 28 may preferably include a servo motor. The temperature detecting parts 26, 27 may preferably include a thermistor or a temperature sensor.

Figure 3:
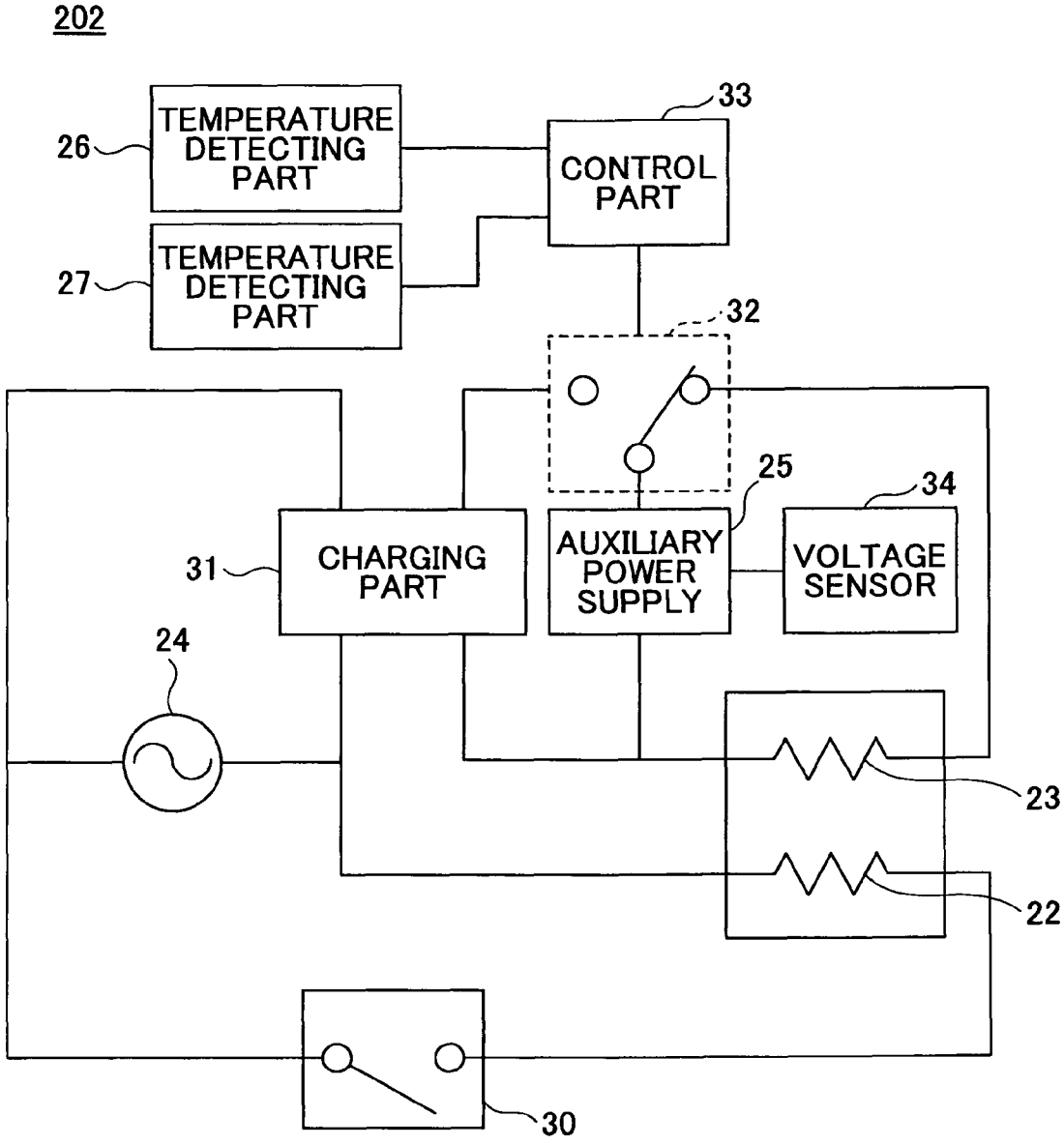
FIG. 3 is a circuit diagram showing a configuration of a fixing apparatus (fixing part) according to an embodiment of the present invention.

FIG. 3 is a circuit diagram showing a configuration of a fixing apparatus (fixing part) 202 according to an embodiment of the present invention. FIG. 3 shows the main heater 22 and the auxiliary heater 23 of the fixing apparatus 202, the AC power supply 24 for supplying power to the main heater 22, a control switching part 30 for switching on and off the power supplied from the AC power supply 24 to the main heater 22, the auxiliary power supply 25 for supplying power to the auxiliary heater 23, a charging part 31 for charging the auxiliary power supply 25 by receiving power from the AC power supply 24, a charge/discharge switching part 32, the temperature detecting part 26 for detecting the surface temperature of the fixing roller 20, the temperature detecting part 27 for detecting the surface temperature of the pressing roller 21, a control part (determining part) 33 for controlling the switching of the charge/discharge switching part 32 based on the temperatures detected by the temperature detecting parts 26, 27 and other control data, and a voltage sensor 34 for detecting the voltage of the auxiliary power supply 25.

As described above, the AC power supply 24 supplies power to the main heater 22. The power supply to the main heater 22 is switched on and off by the control switch 30. The temperature of the fixing roller 20 is maintained at a predetermined temperature mainly by the heat of the main heater 22 that is driven by the AC power supply 24.

The auxiliary power supply 25 can be charged by the charging part 31 which is supplied with power from the AC power supply 24. By supplying power to the auxiliary heater 23, the auxiliary heater 23 serves to support the main heater 22 in heating the fixing roller 20. Accordingly, the auxiliary heater 23 is driven, for example, during the starting (rise) of the image forming apparatus, during the return from a standby state (off-mode), and during a case where power supply exceeding the maximum AC power supply is necessary. This can shorten the time for starting the image forming apparatus and stably adjust the temperature of the fixing roller 20.

It is preferable to use an electric double layer capacitor as the auxiliary power supply 25. The characteristics of the electric double layer capacitor enable rapid charging within a few minutes and supplying of high voltage at an early stage of discharging. Such discharging characteristic of the early stage can be effectively used during the starting of the image forming apparatus or during the return of the image forming apparatus from an off-mode. The electric double layer capacitor has a substantially unlimited service life-span and is resistant to deterioration due to repetitive charging and discharging. Hence, the electric double layer capacitor is suitable for the auxiliary power supply of the present invention.

By switching of the charge/discharge switching part 32, the auxiliary power supply 25 can be charged by the charging part 31 and can discharge power to the auxiliary heater 23. In the circuit configuration shown in FIG. 3, the charging part 31 is connected to the AC power supply 24 when the AC power supply 24 is not supplying power to the main heater 22, and supplies power to the auxiliary power supply 25 when the auxiliary power supply 25 is not supplying power to the auxiliary heater 23.

The control part 33 switches the charge/discharge switching part 32 according to the control conditions calculated from temperatures measured by the temperature detecting parts 26, 27.

Next, the control conditions of the control part 33 are described.

Figure 4:
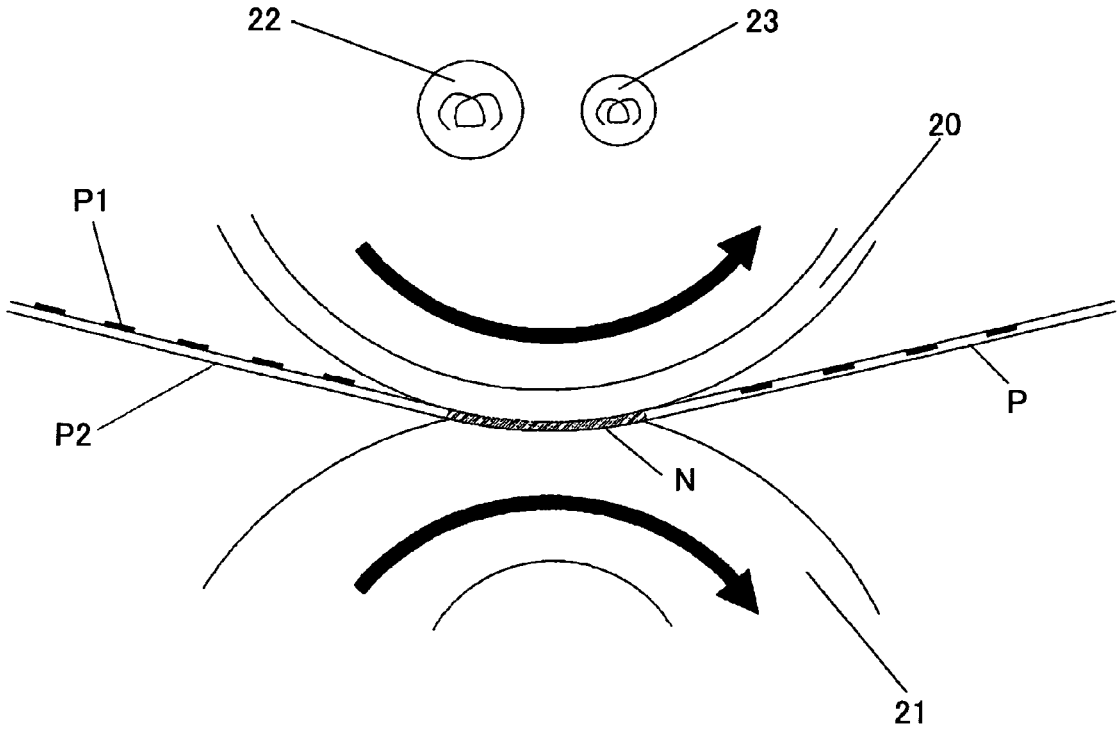
FIG. 4 is a schematic enlarged schematic diagram of a nipping part N situated between a fixing roller and a pressing roller according to an embodiment of the present invention.

FIG. 4 is a schematic enlarged schematic diagram of a nipping part N between the fixing roller 20 and the pressing roller 21 according to an embodiment of the present invention. The fixing roller 20 and the pressing roller 21 apply heat and pressure to a toner layer P1 and a paper layer P2 of the recording medium P at an area in which the fixing roller 20 and the pressing roller 21 are pressed against each other (i.e. nipping part N of the fixing roller 20 and the pressing roller 21). The amount of heat applied from the fixing roller 20 to the toner layer P1 for fixing a toner image onto a recording medium (i.e. fixation heat quantity QH) is calculated with the formula shown below.

$$Q = \frac{2\sqrt{c}\,(T_R T_{TC})(\sqrt{T_0} + \sqrt{R})}{\sqrt{\pi T_0 R}} \qquad \text{[Formula 1]}$$

$c$: NIPPING TIME (sec)

$Q$: FIXATION HEAT QUANTITY ($J/cm^2$)

$\sqrt{T_0}$: HEAT ABSORBTION OF TONER ($J/cm^2\,°C.\sqrt{sec}$)

$\sqrt{R}$: HEAT ABSORBTION OF RELEASING LAYER OF ROLLER ($J/cm^2\,°C.\sqrt{sec}$)

$T_R$: TEMPURATURE OF ROLLER (° C.)

$T_{rc}$: TEMPURATURE OF CONTACT SURFACE OF ROLLER ( = 20° C.)

Furthermore, the amount of heat applied from the pressing roller 21 to the toner layer P1 for fixing a toner image onto a recording medium (i.e. fixation heat quantity Qp) is also calculated with Formula 1. The total fixation heat quantity applied from the fixing roller 20 and the pressing roller 21 to the paper layer P2 is calculated by the formula shown below. [Formula 2]

$$Q_T = Q_H + Q_P \qquad \text{[Formula 2]}$$

$Q_T$: TOTAL FIXATION HEAT QUANTITY ($J/cm^2$)

$Q_H$: FIXATION HEAT QUANTITY APPLIED FROM FIXING ROLLER AT NIPPING PART ($J/cm^2$)

$Q_P$: FIXATION HEAT QUANTITY APPLIED FROM PRESSING ROLLER AT NIPPING PART ($J/cm^2$)

The control part 33 calculates the control conditions including the temperature of the fixing roller, the fixation heat quantity $Q_H$, and the total fixation heat quantity $Q_T$ based on the surface temperature of the fixing roller 20 and the surface temperature of the pressing roller 21. Accordingly, the control part 33 monitors the control conditions for maintaining a state where the calculated temperature of the fixing roller is greater than the a predetermined toner fixation temperature, the calculated fixation heat quantity $Q_H$ is greater than a predetermined toner fixation heat quantity (toner characteristic value), and the calculated total fixation heat quantity $Q_T$ is greater than a predetermined total heat quantity (paper characteristic value). In a case where the control part 33 determines that at least one of the control conditions cannot be maintained in the above-described state, the control part 33 switches the charge/discharge switching part 32 so that the auxiliary heater 23 can be connected to the auxiliary power supply 25 and be heated.

Figure 5:
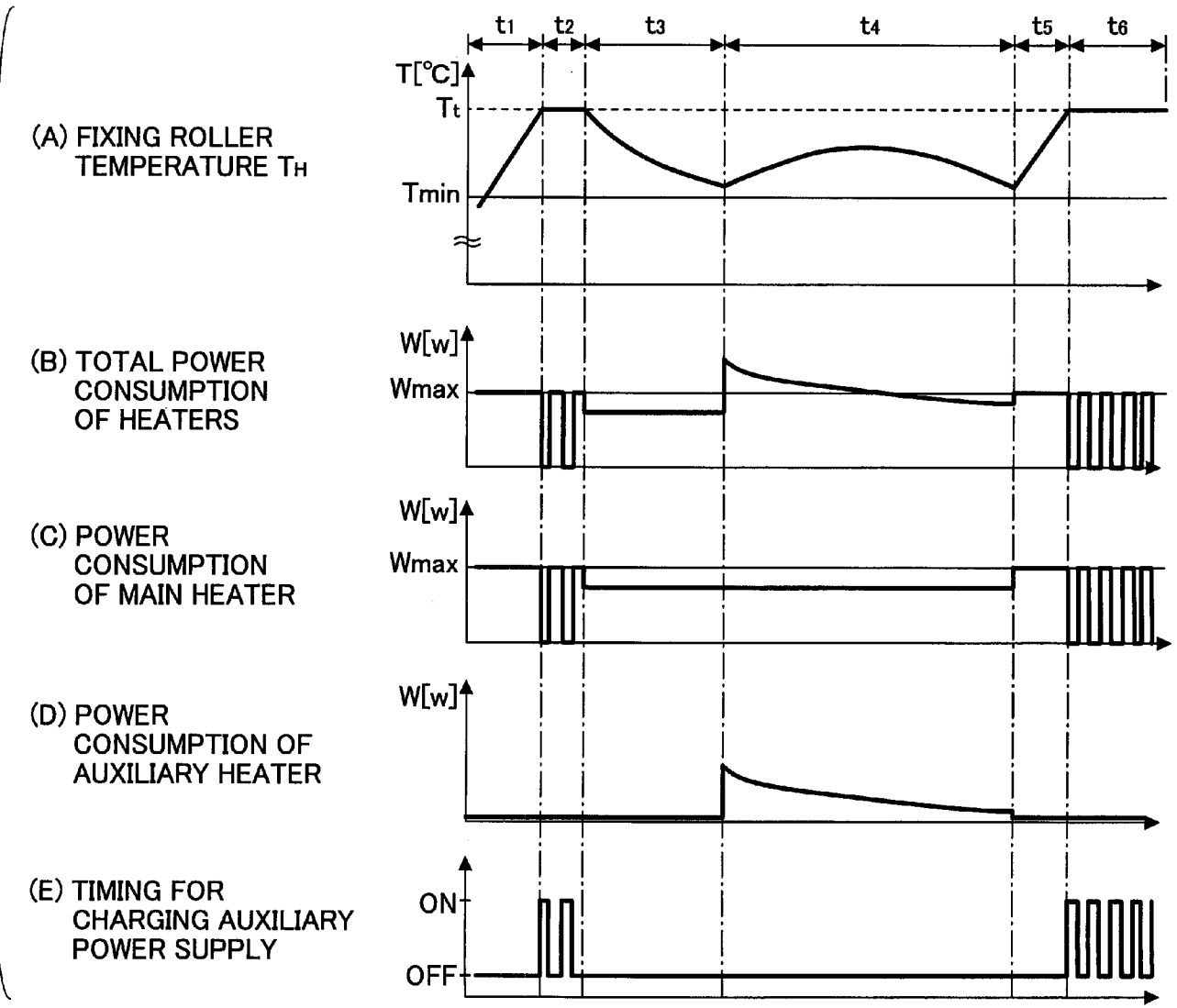
FIG. 5 is a timing chart for describing an exemplary case where an electric double layer capacitor is used as an auxiliary power supply according to an embodiment of the present invention.

Next, the control timing of the control part 33 during execution of a long paper conveying operation is described with FIG. 5. FIG. 5 is a timing chart for describing an exemplary case where an electric double layer capacitor is used as the auxiliary power supply 25. More specifically, in FIG. 5, (A) shows the transition of the temperature of the fixing roller, (B) shows the transition of total power consumption of heaters including the main heater 22 and the auxiliary heater 23, (C) shows the transition of the power consumption of the main heater 22 driven by the AC power supply 24, (D) shows the transition of the power consumption of the auxiliary heater 23 driven by the auxiliary power supply 25, and (E) shows the on/off timing for supplying power to the auxiliary power supply 25.

In FIG. 5, period "t1" indicates a period of raising the temperature of the fixing roller 20 to a predetermined fixing temperature (rise period). In period "t1", only the main heater 22 is heated where only the AC power supply 24 is used. It is, however, possible to shorten the time for heating the fixing roller 20 to the predetermined fixing temperature by heating the auxiliary heater 23 by supplying power from the auxiliary power supply 25 (in this embodiment, electric double layer capacitor) to the auxiliary heater 23.

Next, period "t2" indicates a period of waiting for the completion of reading an original document in a copying operation by the image forming apparatus 1, waiting for the completion of reading a printing job in a printing operation by the image forming apparatus 1, or standing by for initiating the reading processes by the image forming apparatus 1 (standby period). In period "t2", the AC power supply 24 is switched on and off for maintaining the predetermined fixing temperature of the fixing roller 20. In correspondence with the switching of the AC power supply 24, the main heater 22 is driven in a pulsed manner. In this period, it is determined whether there is space (capacity) for charging the auxiliary power supply 25 based on the detection results of the voltage sensor 34. If there is space, the power of the AC power supply 24 is used for charging the auxiliary power supply 25 during the period where the AC power supply 24 is not used for the main heater 22. In a case where the auxiliary power supply 25 is charged to store a predetermined amount of energy according to the detection results of the voltage sensor 34, the charging of the auxiliary power supply 25 is stopped until the next time the voltage sensor 34 detects that there is room (capacity) for charging the auxiliary power supply 25.

Next, periods "t3" and "t4" indicate a period where the fixing apparatus 202 initiates the long-paper conveying operation and fixes a toner image onto a recording medium after reading, for example, an original document with the scanner part 300 in a copying operation or after reading a printing job in a printing operation. At the early stages of the fixing operation, power is supplied only to the main heater 22 from the AC power supply 24. In period "t3", the fixing roller 20 loses heat as a result of having the recording medium (e.g. long-paper) conveyed through the nipping part (fixing part). As shown in (A) of FIG. 5, the temperature of the fixing roller 20 gradually decreases in period "t3".

In period "t3", the control part 33 calculates the control conditions including the temperature of the fixing roller 20, the fixation heat quantity QH, and the total fixation heat quantity $Q_T$ based on the surface temperature of the fixing roller 20 and the surface temperature of the pressing roller 21. Accordingly, the control part 33 monitors the control conditions for maintaining a state where the calculated temperature of the fixing roller is greater than the a predetermined toner fixation temperature, the calculated fixation heat quantity $Q_H$ is greater than a predetermined toner fixation heat quantity, and the calculated total fixation heat quantity $Q_T$ is greater than a predetermined total heat quantity.

In a case where the temperature of the fixing roller 20 decreases, the control part 34 determines that at least one of the above-described control conditions cannot be maintained. When the control part 34 makes such determination, the auxiliary power supply 25 is activated for initiating the heating of the auxiliary heater 23 (end of period "t3"). The AC power in period "t3" ("t4") is less than that of the rise of period "t1" due to the fact that a part of the AC power is converted into DC power for use by other components and mechanisms during, for example, a copying operation.

In period "t4", power is supplied from the AC power supply 24 to the main heater 22 while power is also supplied from the auxiliary power supply (electric double layer capacitor) 25 to the auxiliary heater 23. That is, the total power consumption of the heaters (shown in (B) of FIG. 5) is obtained by adding the power consumption of the main heater 22 (shown in (C) of FIG. 6) and the power consumption of the auxiliary heater 23 (shown in (D) of FIG. 5). By using the total power consumption, the temperature of the fixing roller 20 is heated to a temperature that is no less than the predetermined fixing temperature. It is known that the output of the electric double layer capacitor (i.e. auxiliary power supply 25) decreases as the electric double layer capacitor continues to discharge power. Therefore, the shape of the discharge curve of the auxiliary power supply 25 differs depending on, for example, the capacity of the electric double layer capacitor and/or the output settings of the electric double layer capacitor.

Next, period "t5" indicates a period where the temperature of the fixing roller 20 is raised (returned) to the predetermined fixing temperature again by supplying power from the AC power supply 24 to the main heater 22. It is, however, to be noted that the time for raising the temperature to the predetermined fixing temperature may be shortened by supplying auxiliary power to the auxiliary heater 23.

Next, period "t6" indicates a period of waiting for the completion of reading an original document in a copying operation by the image forming apparatus 1, waiting for the completion of reading a printing job in a printing operation by the image forming apparatus 1, or standing by for initiating the reading processes by the image forming apparatus 1 (standby period). In period "t6", the AC power supply 24 is switched on and off for maintaining the predetermined fixing temperature of the fixing roller 20. In correspondence with the switching of the AC power supply 24, the main heater 22 is driven in a pulsed manner. In this period, it is determined whether there is space for charging the auxiliary power supply 25 based on the detection results of the voltage sensor 34. If there is space, the power of the AC power supply 24 is used for charging the auxiliary power supply 25 during the period where the AC power supply 24 is not used for the main heater 22. In a case where the auxiliary power supply 25 is charged to store a predetermined amount of energy according to the detection results of the voltage sensor 34, the charging of the auxiliary power supply 25 is stopped until the next time the voltage sensor 34 detects that there is room for charging the auxiliary power supply 25.

Hence, in the fixing operation according to the above-described embodiment of the present invention, the auxiliary heater 23 is heated by the auxiliary power source 25 when it is determined that the fixing roller 20 does not satisfy a predetermined condition (e.g. predetermined fixing temperature) required for fixing a toner image onto a recording medium. Accordingly, even in a case where the recording medium is long length paper (e.g. roll of paper or long paper), a satisfactory fixing performance can be attained throughout the above-described periods. As a result, high printing quality can be achieved.

Figure 6:
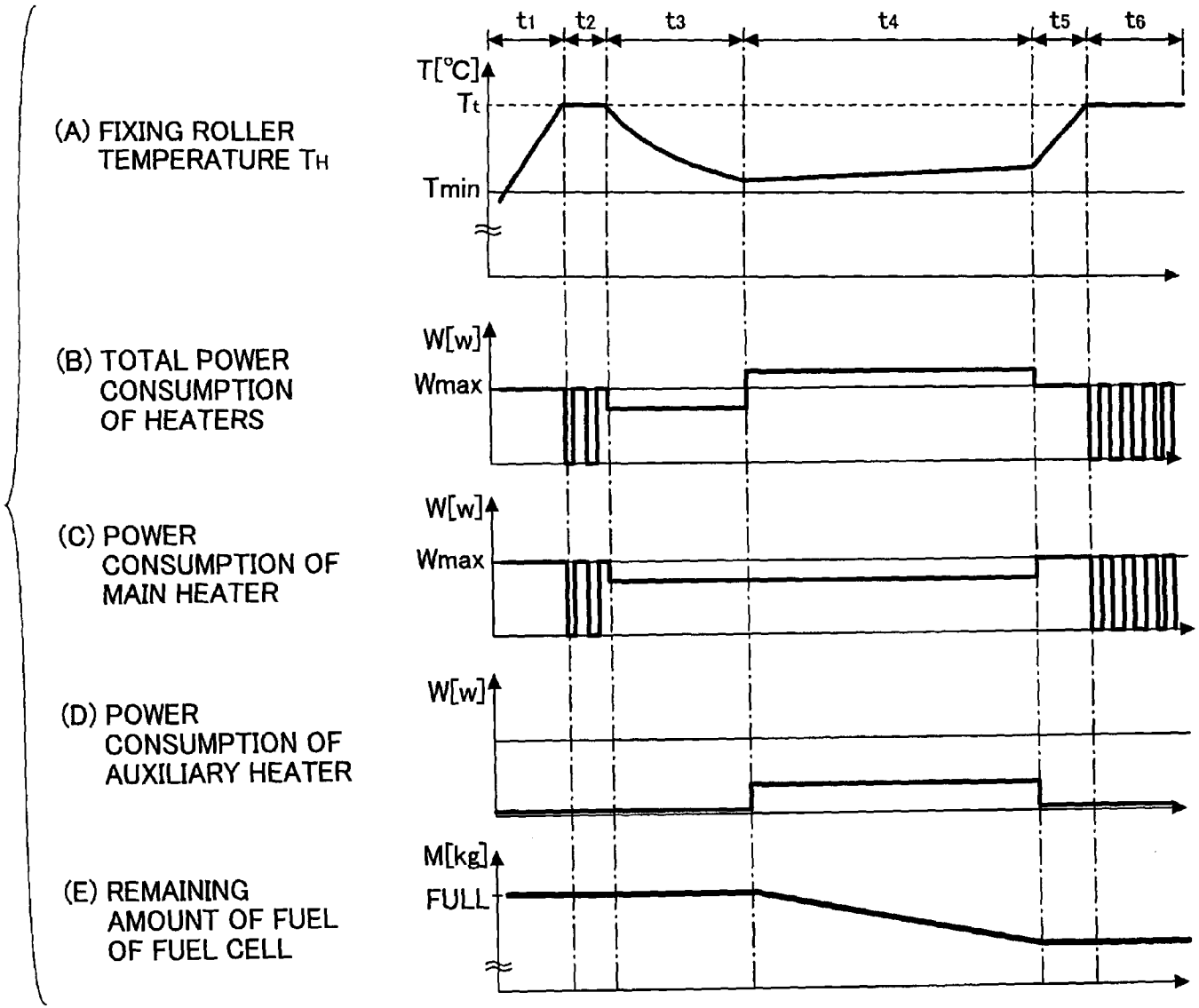
FIG. 6 is another timing chart for describing an exemplary case where a fuel cell is used as an auxiliary power supply according to an embodiment of the present invention.

Next, an image forming apparatus according to another embodiment of the present invention is described, in which an exchangeable fuel cell is used as the auxiliary power supply 25. Since the voltage output of a fuel cell is stable, the use of a fuel cell as the auxiliary power supply 25 enables easy control of the temperature of the fixing roller 20. In addition, since the fuel cell can be exchanged, the auxiliary power supply 25 can be used substantially permanently. FIG. 6 is another timing chart for describing an exemplary case where a fuel cell is used as the auxiliary power supply 25. More specifically, in FIG. 6, (A) shows the transition of the temperature of the fixing roller, (B) shows the transition of total power consumption of heaters including the main heater 22 and the auxiliary heater 23, (C) shows the transition of the power consumption of the main heater 22 driven by the AC power supply 24, (D) shows the transition of the power consumption of the auxiliary heater 23 driven by the auxiliary power supply 25, and (E) shows the remaining amount of fuel of the fuel cell used as the auxiliary power cell 25.

In FIG. 6, period "t1" indicates a period of raising the temperature of the fixing roller 20 to a predetermined fixing temperature (rise period). In period "t1", only the main heater 22 is heated where only the AC power supply 24 is used. It is, however, possible to shorten the time for heating the fixing roller 20 to the predetermined fixing temperature by heating the auxiliary heater 23 by supplying power from the auxiliary power supply 25 (in this embodiment, fuel cell) to the auxiliary heater 23.

Next, period "t2" indicates a period of waiting for the completion of reading an original document in a copying operation by the image forming apparatus 1, waiting for the completion of reading a printing job in a printing operation by the image forming apparatus 1, or standing by for initiating the reading processes by the image forming apparatus 1 (standby period). In period "t2", the AC power supply 24 is switched on and off for maintaining the predetermined fixing temperature of the fixing roller 20. In correspondence with the switching of the AC power supply 24, the main heater 22 is driven in a pulsed manner. In this period, it is determined whether there is space for charging the auxiliary power supply 25 based on the detection results of the voltage sensor 34. If there is space, the power of the AC power supply 24 is used for charging the auxiliary power supply 25 during the period where the AC power supply 24 is not used for the main heater 22. In a case where the auxiliary power supply 25 is charged to store a predetermined amount of energy according to the detection results of the voltage sensor 34, the charging of the auxiliary power supply 25 is stopped until the next time the voltage sensor 34 detects that there is room for charging the auxiliary power supply 25.

Next, periods "t3" and "t4" indicate a period where the fixing apparatus 202 initiates the long-paper conveying operation and fixes a toner image onto a recording medium after reading, for example, an original document with the scanner part 300 in a copying operation or after reading a printing job in a printing operation. At the early stages of the fixing operation, power is supplied only to the main heater 22 from the AC power supply 24. In period "t3", the fixing roller 20 loses heat as a result of having the recording medium (e.g. long-paper) conveyed through the nipping part (fixing part). As shown in (A) of FIG. 6, the temperature of the fixing roller 20 gradually decreases in period "t3".

In period "t3", the control part 33 calculates the control conditions including the temperature of the fixing roller 20, the fixation heat quantity QH, and the total fixation heat quantity $Q_T$ based on the surface temperature of the fixing roller 20 and the surface temperature of the pressing roller 21. Accordingly, the control part 33 monitors the control conditions for maintaining a state where the calculated temperature of the fixing roller is greater than the a predetermined toner fixation temperature, the calculated fixation heat quantity $Q_H$ is greater than a predetermined toner fixation heat quantity, and the calculated total fixation heat quantity $Q_T$ is greater than a predetermined total heat quantity.

In a case where the temperature of the fixing roller 20 decreases, the control part 34 determines that at least one of the above-described control conditions cannot be maintained. When the control part 34 makes such determination, the auxiliary power supply 25 is activated for initiating the heating of the auxiliary heater 23 (end of period "t3"). The AC power in period "t3" ("t4") is less than that of the rise of period "t1" due to the fact that a part of the AC power is converted into DC power for use by other components and mechanisms during, for example, a copying operation.

In period "t4", power is supplied from the AC power supply 24 to the main heater 22 while power is also supplied from the auxiliary power supply 25 (in this embodiment, fuel cell) to the auxiliary heater 23. That is, the total power consumption of the heaters (shown in (B) of FIG. 6) is obtained by adding the power consumption of the main heater 22 (shown in (C) of FIG. 6) and the power consumption of the auxiliary heater 23 (shown in (D) of FIG. 6). By using the total power consumption, the temperature of the fixing roller 20 is heated to a temperature that is no less than the predetermined fixing temperature. Unlike the above-described case of using an electric double layer capacitor as the auxiliary power supply 25, the temperature of the fixing roller 20 increases linearly in a case where a fuel cell is used as the auxiliary power supply 25. It is known that the amount of fuel of the fuel cell decreases as the fuel cell continues to discharge power. It is, therefore, preferable that the image forming apparatus 1 according to this embodiment of the present invention be configured to constantly monitor the amount of fuel remaining in the fuel cell. Furthermore, it is preferable to communicate the remaining amount of fuel to the user through the operating part (e.g. control panel). It is preferable for the fuel cell to be configured as, for example, a cartridge type fuel cell that allows the fuel cell to be easily exchanged.

Next, period "t5" indicates a period where the temperature of the fixing roller 20 is raised (returned) to the predetermined fixing temperature again by supplying power from the AC power supply 24 to the main heater 22. It is, however, to be noted that the time for raising the temperature to the predetermined fixing temperature may be shortened by supplying auxiliary power to the auxiliary heater 23.

Next, period "t6" indicates a period of waiting for the completion of reading an original document in a copying operation by the image forming apparatus 1, waiting for the completion of reading a printing job in a printing operation by the image forming apparatus 1, or standing by for initiating the reading processes by the image forming apparatus 1 (standby period). In period "t6", the AC power supply 24 is switched on and off for maintaining the predetermined fixing temperature of the fixing roller 20. In correspondence with the switching of the AC power supply 24, the main heater 22 is driven in a pulsed manner. In this period, it is determined whether there is space for charging the auxiliary power supply 25 based on the detection results of the voltage sensor 34. If there is space, the power of the AC power supply 24 is used for charging the auxiliary power supply 25 during the period where the AC power supply 24 is not used for the main heater 22. In a case where the auxiliary power supply 25 is charged to store a predetermined amount of energy according to the detection results of the voltage sensor 34, the charging of the auxiliary power supply 25 is stopped until the next time the voltage sensor 34 detects that there is room for charging the auxiliary power supply 25.

Hence, in the fixing operation according to the above-described embodiment of the present invention, the auxiliary heater 23 is heated by the auxiliary power source 25 when it is determined that the fixing roller 20 does not satisfy a predetermined condition(s) required for fixing a toner image onto a recording medium (e.g. predetermined fixing temperature). Accordingly, even in a case where the recording medium is long length paper (e.g. roll of paper or long paper), a satisfactory fixing performance can be attained throughout the above-described periods. As a result, high printing quality can be achieved.

Second Embodiment

Next, a fixing apparatus 1202 according to the second embodiment of the present invention is described. The fixing apparatus 1202 of the second embodiment may be mounted to, for example, the image forming apparatus 1 described in the first embodiment of the present invention. The fixing apparatus 1202 has substantially the same configuration as the fixing part 202 described in the first embodiment of the present invention. The fixing apparatus 1202 includes a fixing roller (fixing member) 1010 and a pressing roller (pressing member) 1012 that presses against the fixing roller 1010. The fixing roller 1010 and the pressing roller 1012 have substantially the same configuration as the fixing roller 20 and the pressing roller 21 of the first embodiment of the present invention. The area in which the pressing roller 1012 presses against the fixing roller 1010 for fixing a toner image onto a transfer sheet (recording medium) is referred to as a nipping part N.

Figure 7:
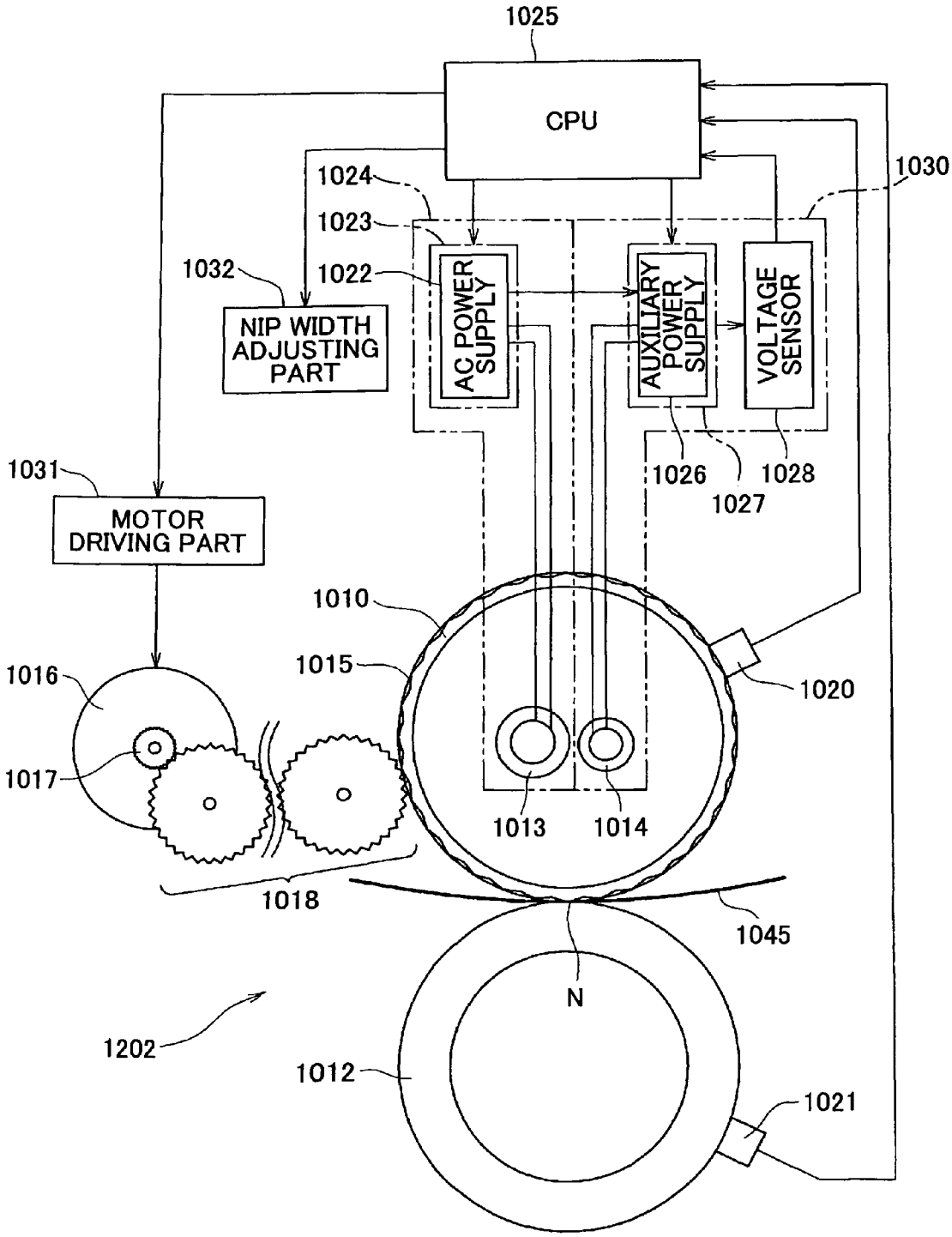
FIG. 7 is a schematic view showing a fixing apparatus and an electric circuit for controlling the fixing apparatus according to an embodiment of the present invention.

FIG. 7 is a schematic view showing a fixing apparatus 1202 and an electric circuit for controlling the fixing apparatus 1202 according to the second embodiment of the present invention. In this embodiment, the fixing apparatus 1202 is mounted to the image forming apparatus 1 shown in FIG. 1.

As shown in FIG. 7, a main heating member 1013 mounted to the fixing apparatus 1202 is connected to a main power supplying part 1023 including an AC power supply (i.e. main power supply) 1022. Thereby, a main heating apparatus 1024 including the main heating member 1013 and the main power supplying part 1023 is obtained. The main power supplying part 1023 included in the main heating apparatus 1024 is connected to a CPU 1025. The CPU 1025 controls the supply of AC voltage from the AC power supply 1022 of the main power supplying part 1023 to the main heating member 1013. Thereby, the main heating member 1013 is heated for heating the fixing roller 1010.

Furthermore, an auxiliary heating member 1014 mounted to the fixing apparatus 1202 is connected to an auxiliary power supplying part 1027 including an auxiliary power supply 1026. The auxiliary power supply 1026 may be, for example, an electric double layer capacitor (e.g. chargeable/dischargeable electric double layer capacitor) or a fuel cell (e.g. replaceable fuel cell). A voltage sensor (voltage detecting part) 1028 is connected to the auxiliary power supply 1026 for detecting power supplied to the auxiliary power supply 1026. Thereby, an auxiliary heating apparatus 1030 includes the auxiliary heating member 1014, the auxiliary power supplying part 1027, and the voltage sensor 1028. The auxiliary power supplying part 1027 included in the auxiliary heating apparatus 1030 is connected to the CPU 1025. The detection results of the voltage sensor 1028 are input to the CPU 1025. The CPU 1025 controls the supply of voltage from the auxiliary power supply 1026 of the auxiliary power supplying part 1027 to the auxiliary heating member 1014. Thereby, the auxiliary heating member 1014 is heated for heating the main heating member 1013 and/or the fixing roller 1010.

The fixing apparatus 1202 also includes a first temperature detecting part 1020 and a second temperature detecting part 1021 which are connected to the CPU 1025. The detection results of the first and second temperature detecting parts 1020 and 1021 are also input to the CPU 1025. Furthermore, a motor driving part 1031 is also connected the CPU 1025. The motor driving part 1031 drives an electromagnetic motor 1016 according to signals transmitted from the CPU 1025. Accordingly, the electromagnetic motor 1016 rotates the fixing roller 1010 and the pressing roller 1012. Furthermore, a nip width adjusting part 1032 is connected to the CPU 1025. The nip width adjusting part 1032 adjusts width (space) of the nipping part N between the fixing roller 1010 and the pressing roller 1012 according to the signals transmitted from the CPU 1025.

Figure 8:
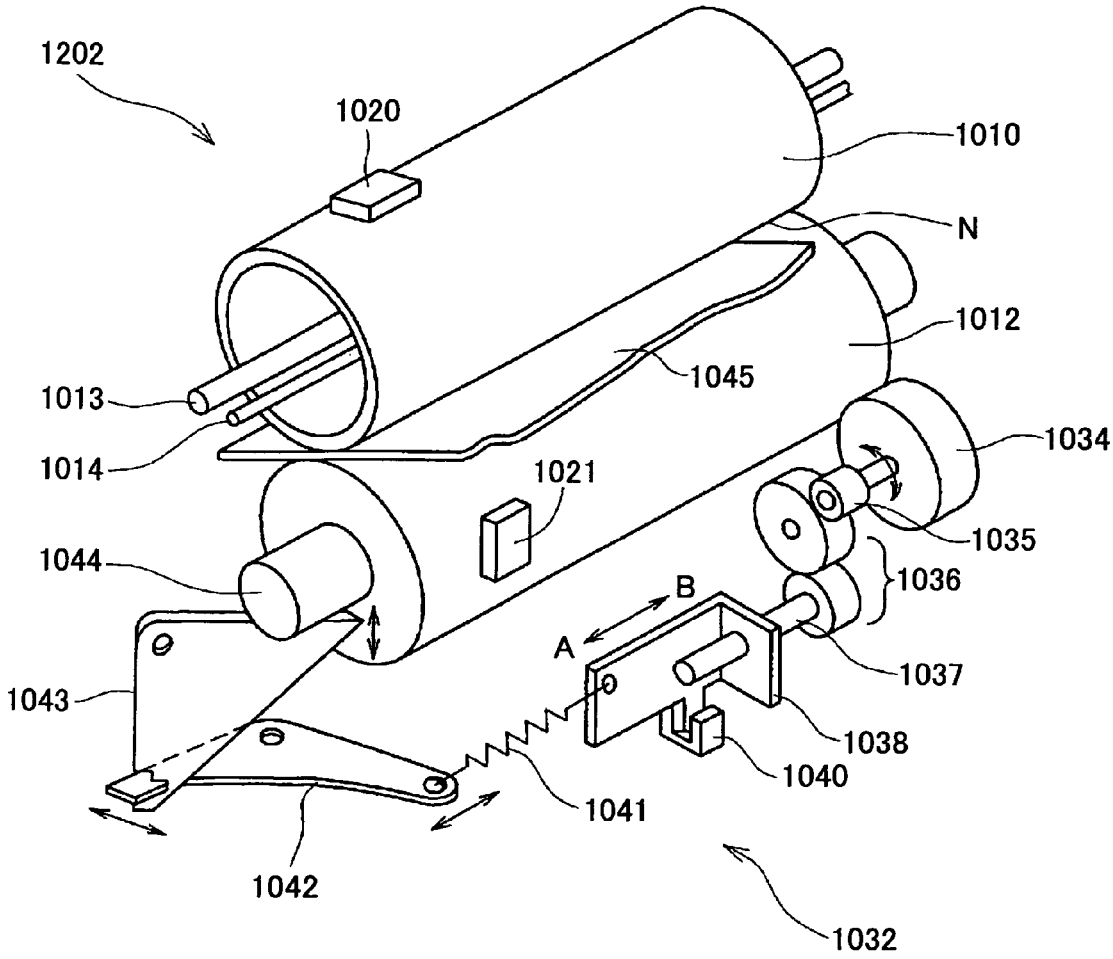
FIG. 8 is a schematic view showing a nip width adjusting part included in a fixing apparatus according to an embodiment of the present invention.

FIG. 8 is a schematic view showing a nip width adjusting part 1032 of the fixing apparatus 1202. As shown in FIG. 8, the nip width adjusting part 1032 includes a nip width adjusting motor 1034. The nip width adjusting motor 1034 transmits a driving force from its motor gear 1035 to an inserting screw 1037 via plural gears 1036. The inserting screw 1037 is fastened to a bracket 1038. The bracket 1038 is moved in directions A and B depending on whether the nip width adjusting motor is rotated forward or in reverse. A position sensor 1040 detects the reference position of the bracket 1038.

The movement of the bracket 1038 causes the tension of a spring 1041 to increase and decrease. In correspondence with the expansion and contraction of the spring 1041, a horizontal cam 1042 and a vertical cam 1043 having one end engaged to the horizontal cam 1042 are rotated. The other end of the vertical cam 1043 is engaged to a roller axle 1044 of the pressing roller 1012. The rotation of the vertical cam 1042 causes the roller axle 1044 to move vertically, to thereby increase and decrease the pressing force of the pressing roller 1012 contacting against the fixing roller 1010. In other words, the nip width adjusting motor 1034 (i.e. driving part) transmits a driving force to the vertical cam 1043 (i.e. cam member) via a driving force transmitting part including, for example, the plural gears 1036, the inserting screw 1037, the bracket 1038, the spring 1041, and the horizontal cam 1042, so that the vertical cam 1043 urges the pressing roller 1012 and changes the elastic deformation of the rubber layer of the pressing roller 1012. Thereby, the width (space) of the nipping part N is adjusted. Accordingly, the time required for conveying a transfer sheet (recording medium) 1045 through the nipping part N between the fixing roller 1010 and the pressing roller 1012 changes in accordance with the adjusted width of the nipping part N. Thus, the heat quantity applied to the transfer sheet (recording medium) 1045 can be controlled.

Figure 9A:
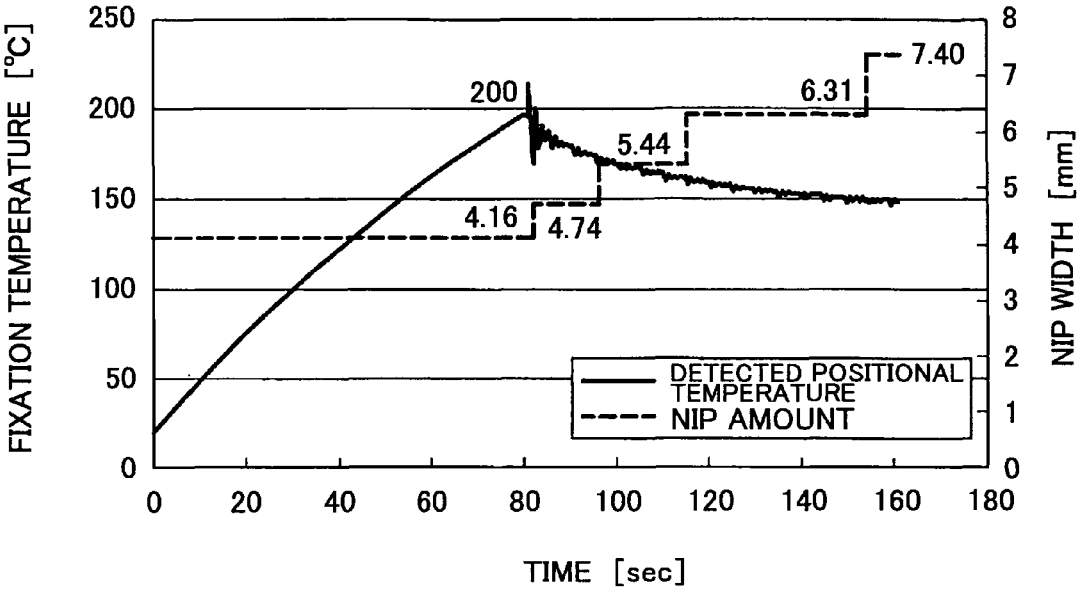
FIG. 9A is a graph showing the relationship between the time [sec.] elapsed after turning on an image forming apparatus and the surface temperature [° C.] of a fixing roller, and the relationship between the time [sec.] after turning on the image forming apparatus and a nip width adjusted by a nip width adjusting part according to an embodiment of the present invention (graph for showing relationship between fixing roller temperature and change of nip width)
Figure 9B:
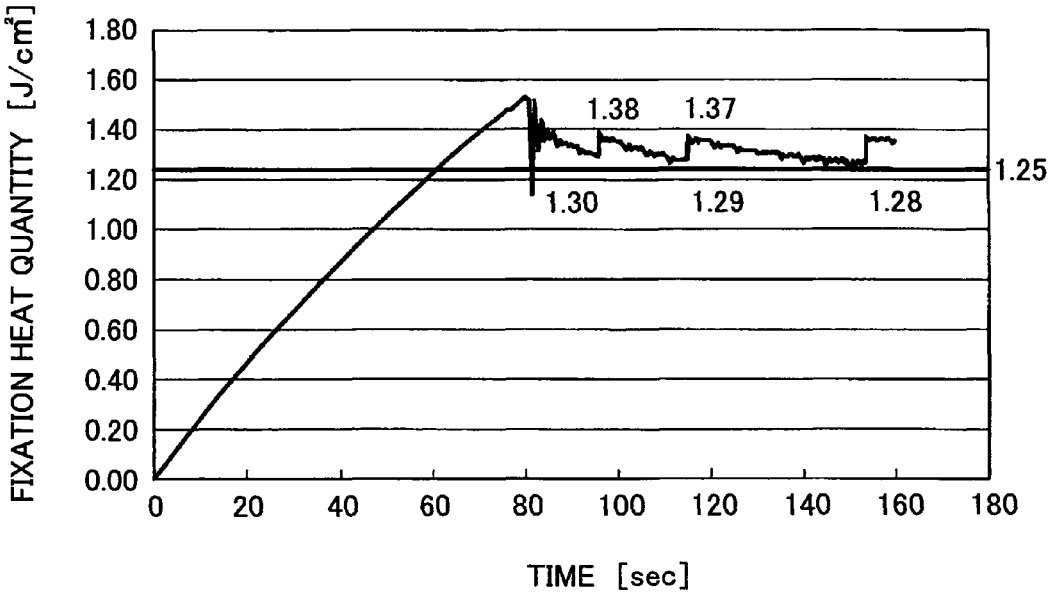
FIG. 9B is a graph showing the relationship between the time [sec.] elapsed after turning on an image forming apparatus and the fixation heat quantity [J/cm$^2$] applied to the toner on the surface of a transfer sheet in a case where the nip width is increased step by step by a nip width adjusting part according to an embodiment of the present invention (graph for showing fixation heat quantity)

FIG. 9A is a graph showing the relationship between the time [sec.] elapsed after turning on the image forming apparatus 1 and the surface temperature [° C.] of the fixing roller 1010, and the relationship between the time [sec.] after turning on the image forming apparatus 1 and the nip width adjusted by the nip width adjusting part 32 according to an embodiment of the present invention (graph for showing relationship between fixing roller temperature and change of nip width). FIG. 9B is a graph showing the relationship between the time [sec.] elapsed after turning on the image forming apparatus 1 and the fixation heat quantity [J/cm$^2$] applied to the toner on the surface of the transfer sheet 1045 in a case where the nip width is increased step by step by the nip width adjusting part 1032 according to an embodiment of the present invention (graph for showing fixation heat quantity).

In the example shown in FIGS. 9A and 9B, for the initial state of the image forming apparatus 1 including the fixing apparatus 1202, the initial nip width of the nipping part N is 4.16 mm. In this state, the image forming apparatus 1 is turned on and the main heater 13 is charged for heating the fixing roller 1010. When the surface temperature of the fixing roller 1010 rises to 200° C. approximately 80 seconds after the image forming apparatus 1 is turned on, a long-paper conveying operation of conveying a transfer sheet (recording medium) 1045 through the nipping part N between the fixing roller 1010 and the pressing roller 1012 is started. As the transfer sheet 1045 is conveyed through the nipping part N, the heat of the fixing roller 1010 is absorbed by the transfer sheet 1045. Accordingly, the surface temperature of the fixing roller 1010 gradually decreases in the manner shown in the graph of FIG. 9A.

In this example, the heat quantity required for fixing toner onto the surface of the transfer sheet 1045 is approximately 1.25 J/cm$^2$. It is determined that a shortage of fixation heat quantity may occur when the fixation heat quantity falls to 1.30 J/cm$^2$. When such a determination is made, the nip width adjusting part 1032 increases the nip width from the initial width of 4.16 mm to 4.74 mm. As a result, the fixation heat quantity recovers from 1.30 J/cm$^2$ to 1.38 J/cm$^2$, so that satisfactory fixing performance can be maintained when conveying the transfer sheet 1045 through the nipping part N. Then, the nip width adjusting part 1032 further increases the nip width of the nipping part N to 5.44 mm at the point where the fixation heat quantity of the fixing roller 1010 falls to approximately 1.29 J/cm$^2$. As a result, the fixation heat quantity recovers to 1.37 J/cm$^2$. Then, the nip width adjusting part 1032 further increases the nip width of the nipping part N to 6.31 mm at the point where the fixation heat quantity of the fixing roller 1010 falls to approximately 1.28 J/cm$^2$. Then, the nip width adjusting part 1032 further increases the nip width of the nipping part N to 7.40 mm at the point where the fixation heat quantity of the fixing roller 1010 falls to approximately 1.28 J/cm$^2$. Hence, the fixing roller 1010 can maintain a fixation heat quantity of approximately 1.25 J/cm$^2$ or more by increasing the nip width in the above-described step-by-step manner.

Figure 10:
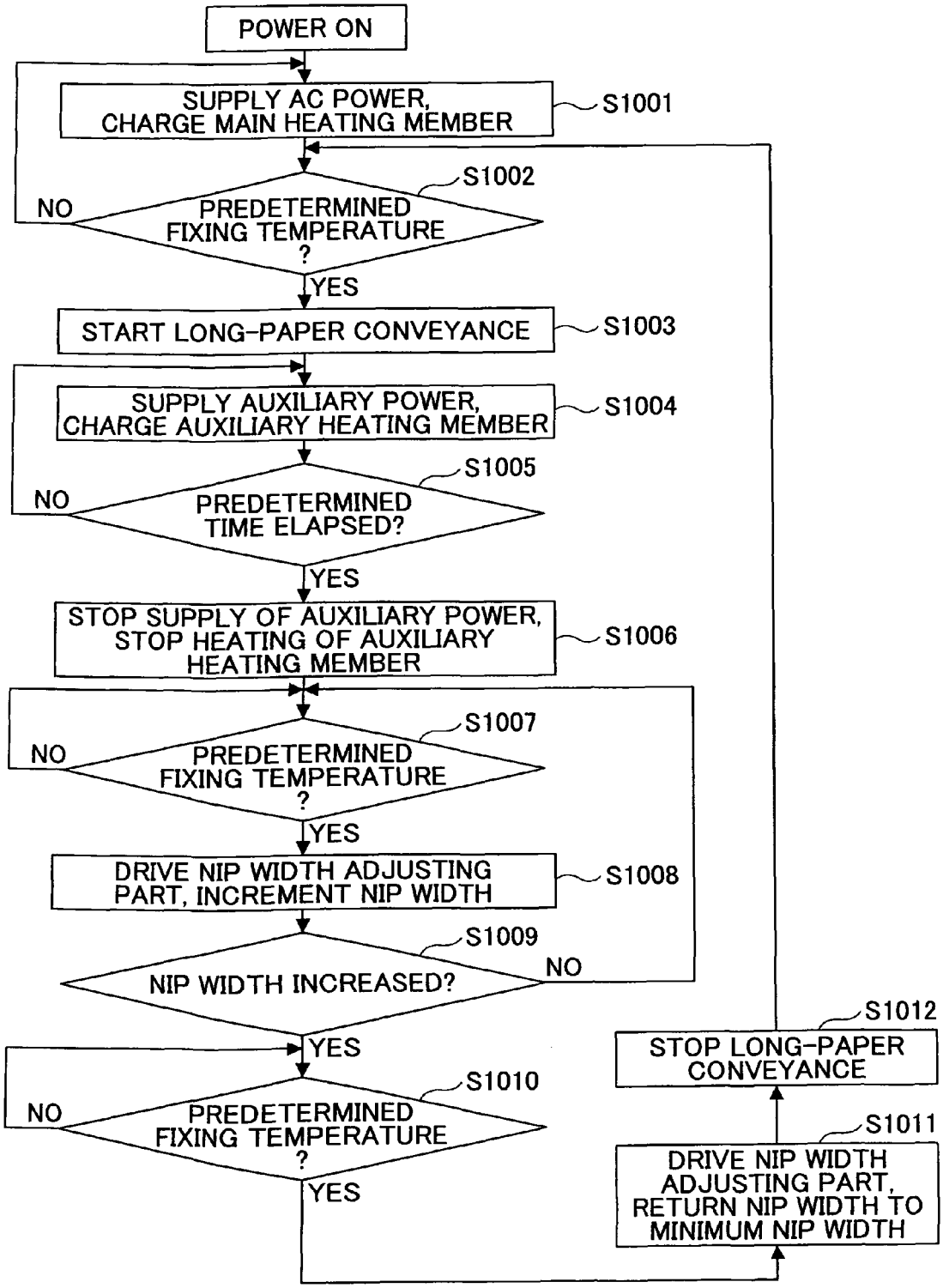
FIG. 10 is a flowchart showing a method of controlling a fixing operation of a fixing apparatus included in an image forming apparatus according to an embodiment of the present invention.

FIG. 10 is a flowchart of a method of controlling the fixing operation of the fixing apparatus 1202 of the image forming apparatus 1 according to an embodiment of the present invention.

In a case of fixing a toner image onto a transfer sheet (recording medium) 1045 having a long length (e.g. 15 m) or a width greater than A2 size paper with a conventional fixing apparatus, the fixation temperature of the fixing apparatus tends to decrease as the heat of its fixing roller or pressing roller is gradually absorbed by the transfer sheet conveyed through the nipping part N between the fixing roller 1010 and the pressing roller 1012. This leads to unsatisfactory fixing results. However, such problems can be prevented by using the method according to an embodiment of the present invention as shown in FIG. 10.

After the power of the image forming apparatus 1 (e.g. copier) is turned on, an image forming process including a fixing operation is performed with the controls of the CPU 1025. In Step S1, the main heating apparatus (main heater) 1024 is activated for allowing power to be supplied from the AC power supply 1022 of the main power supplying part 1023 to the main heating member 1013. Accordingly, the charged main heating member 1013 heats the fixing roller 1010 to a predetermined fixation temperature.

Figure 11:
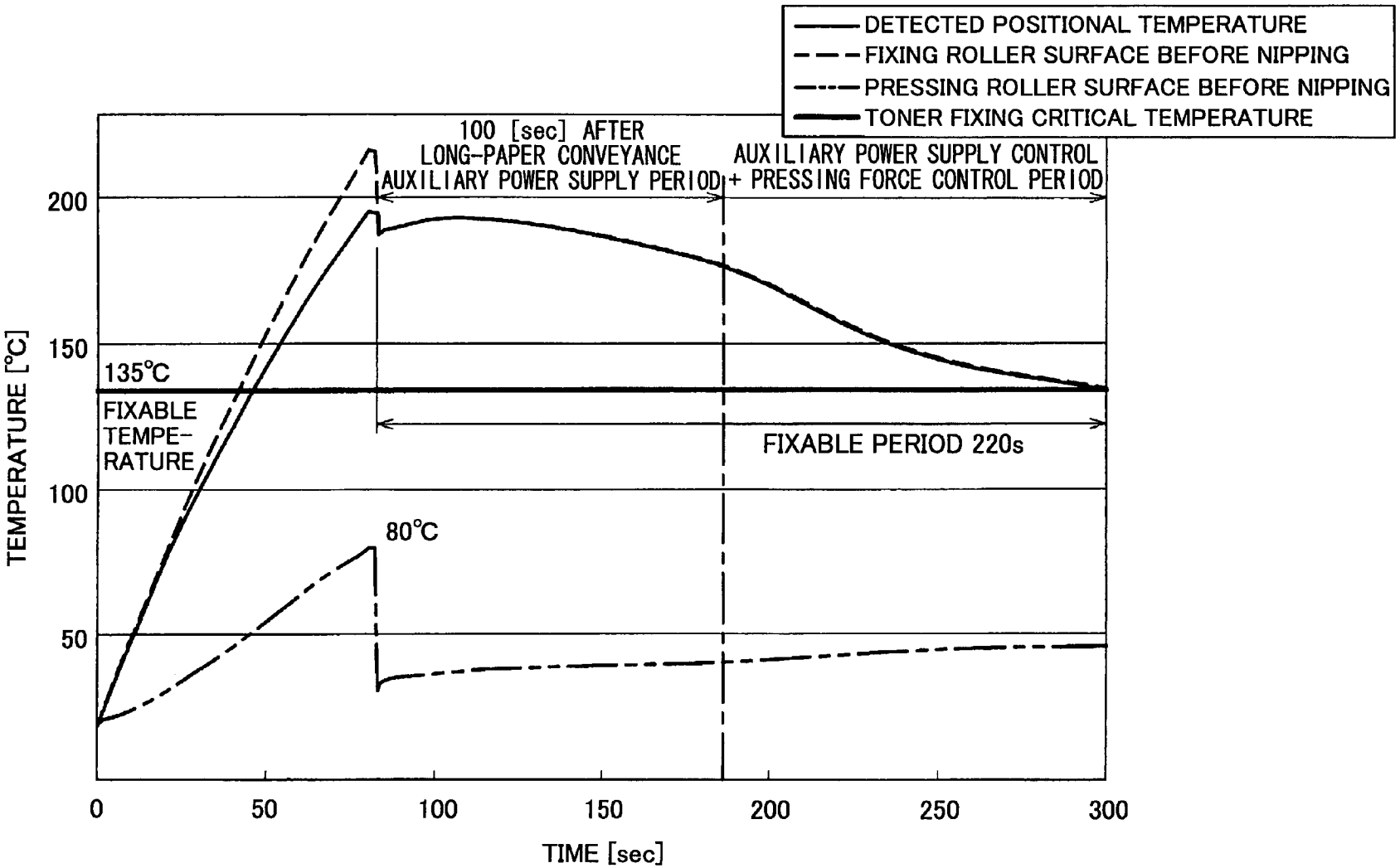
FIG. 11 is a graph showing a relationship between the time [sec.] elapsed after an image forming apparatus is turned on and the surface temperatures of a fixing roller and a pressing roller according to an embodiment of the present invention.

FIG. 11 is a graph showing a relationship between the time [sec.] elapsed after the image forming apparatus 1 is turned on and the surface temperatures of the respective rollers 1010, 1012.

As shown in FIG. 11, the surface temperature of the fixing roller 1010 increases rapidly as the main heating member 1013 is heated. The first temperature detecting part 1020 detects that the temperature of the fixing roller 1010 has reached the predetermined fixation temperature (in this example, 195° C.) around the time when 80 seconds elapses after turning on the power of the image forming apparatus 1. In addition, the second temperature detecting part 1021 detects that the temperature of the pressing roller 1012 is approximately 80° C. around the time when 80 seconds elapses after turning on the power of the image forming apparatus 1. Accordingly, at this time, the pressing roller 1012 is not in a fully charged stated. If the pressing roller 1012 were in a fully charged state, the rate of change of temperature can be made lower.

Returning to Step S2 of FIG. 10, the first temperature detecting part 1020 determines whether the surface temperature of the fixing roller 1010 has reached the predetermined fixation temperature (in this example, 195° C.) When the first temperature detecting part 1020 determines that the surface temperature of the fixing roller 1010 has reached the predetermined fixation temperature (Yes in Step S2), the long-paper conveying operation is started by inserting the transfer sheet 1045 having a toner image transferred thereon into the nipping part N (Step S3).

Figure 12:
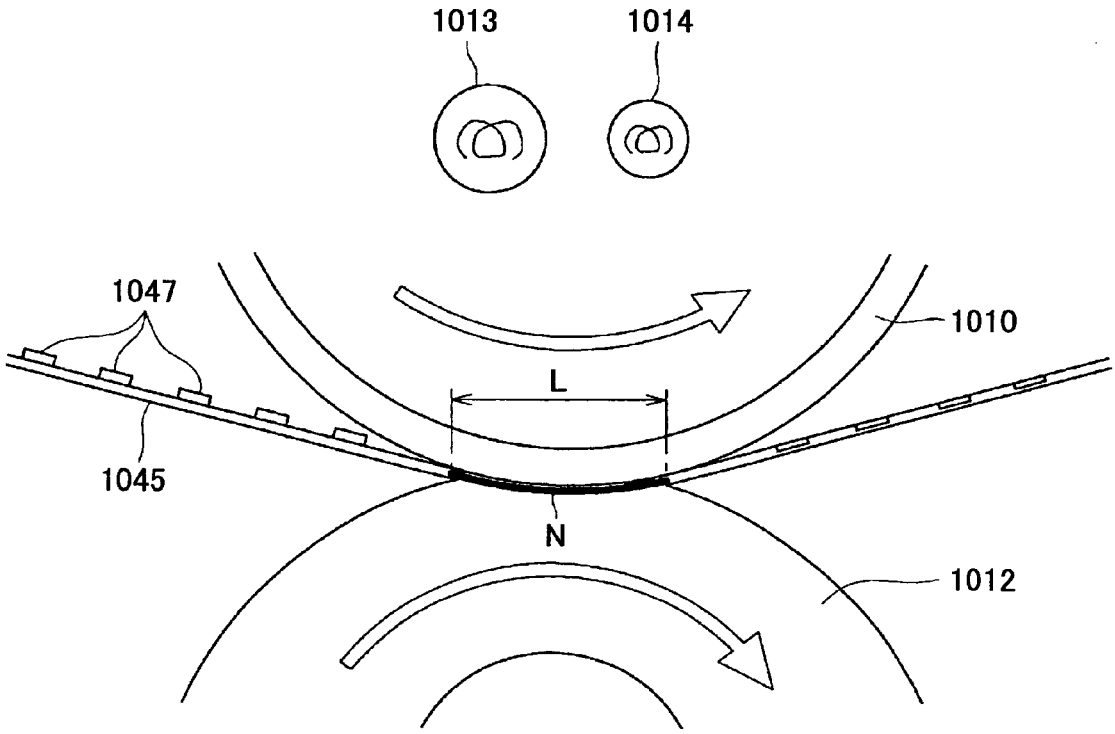
FIG. 12 is a schematic drawing for describing a fixing operation of a fixing apparatus included in an image forming apparatus according to an embodiment of the present invention.

FIG. 12 is a schematic drawing for describing the fixing operation of the fixing apparatus 1202. In the fixing operation, the transfer sheet 1045 inserted through the nipping part N has heat and pressure applied by the fixing roller 1010 and the pressing roller 1012. Thereby, the toner image 1047 on the surface of the transfer sheet 1045 is fixed onto the transfer sheet 1045 as the transfer sheet 1045 is conveyed through the nipping part N. As the transfer sheet 1045 advances through the nipping part N, the surface temperatures of the fixing roller 1010 and the pressing roller 1012 begin to decrease. Accordingly, in Step S4, the auxiliary heating apparatus (auxiliary heater) 1030 is activated for allowing power to be supplied from the auxiliary power supplying part 1027 of the auxiliary power supply 1026 to the auxiliary heating member 1014 of the auxiliary heater 1030. Accordingly, in addition to the heat from the main heating member 1013, the auxiliary heating member 1014 also begins to apply heat to the fixing roller 1010. Therefore, although the surface temperature of the fixing roller 1010 decreases to some degree (as shown in FIG. 11), the fixing roller 1010 is able to maintain a substantially high temperature.

However, in a case where an electric double layer capacitor is used as the auxiliary power supply 1026, the discharging characteristic of the electric double layer capacitor causes the voltage of the auxiliary power supply 1026 to gradually decrease after a predetermined time elapses from the start of the long-paper conveying operation and eventually lowers the voltage to a level where the necessary fixation heat quantity cannot be maintained. Normally, the decrease of voltage begins approximately 100 seconds after the long-paper conveying operation is started (this period may differ depending on the performance of the capacitor). Accordingly, in Step S5, it is determined whether 100 seconds has elapsed from the start of the long-paper conveying operation (fixing operation). When it is determined that 100 seconds has elapsed (Yes in Step S5), the charging of the auxiliary heating member 1014 is stopped by stopping the supply of power to the auxiliary power supply 1026 (Step S6). Accordingly, the surface temperature of the fixing roller 1010 gradually decreases as shown in FIG. 11.

Then, it is determined whether the surface temperature of the fixing roller 1010 is greater than a predetermined temperature, that is, whether there is sufficient amount of fixation heat quantity (Step S7). In a case where the surface temperature of the fixing roller 1010 is no greater than the predetermined temperature (Yes in Step S7), the pressing force of the pressing roller 1012 applied against the fixing roller 1010 is increased by driving the nip width adjusting part 1032, in which the nip width is adjusted (in this example, incremented) one step higher from the initial nip width (see "L" of FIG. 12). Then, it is determined whether to further increase the nip width by comparing the nip width with a maximum nip width (Step S9). In a case where the nip width has not reached the maximum nip width, the nip width is further incremented by increasing the fixation heat quantity step by step. Accordingly, as shown in FIG. 11, the fixing roller 1010 maintains a temperature that is no less than the predetermined fixation temperature of 135° C. for approximately 220 seconds after starting the long-paper conveying operation.

In a case where the nip width is determined to be equal to the maximum nip width, the long-paper conveying operation is continued until the surface temperature of the fixing roller 1010 is determined to be no greater than the predetermined fixation temperature (Step S10). That is, the long-paper conveying operation is continued until it is determined that the fixation heating quantity is insufficient. In a case where the surface temperature of the fixing roller 1010 becomes no greater than the predetermined fixation temperature (Yes in Step S10), the nip width is returned to the initial nip width by driving the nip width adjusting part 1032 (Step S11). Then, the long-paper conveying operation is stopped (Step S12), and the fixing operation returns to Step S2. Again, it is determined whether the surface temperature of the fixing roller 1010 has increased to a temperature greater than the predetermined fixation temperature. The long-paper conveying operation is again started and continued until the job is completed.

The timing chart shown in FIG. 5 and the above-described Formulas 1 and 2 of the first embodiment may also be applied to performing the long-paper conveying operation of the second embodiment in a case where an electric double layer capacitor is used as the auxiliary power supply 1026 of the fixing apparatus 1202. That is, the timing chart of FIG. 5 can also be used to show the heating operation of the fixing roller 1010 prior to starting the above-described nip width adjusting operation of the second embodiment. Furthermore, the timing chart shown in FIG. 6 may also be applied to performing the long-paper conveying operation of the second embodiment in a case where a fuel cell is used as the auxiliary power supply 1026 of the fixing apparatus 1202. That is, the timing chart of FIG. 6 can also be used to show the heating operation of the fixing roller 1010 prior to starting the above-described nip width adjusting operation of the second embodiment. However, since the timing charts of FIGS. 5 and 6 are already described in detail in the first embodiment of the present invention, the long-paper conveying operation of the second embodiment will not be further described with reference to the timing charts of FIGS. 5 and 6.

Figure 13:
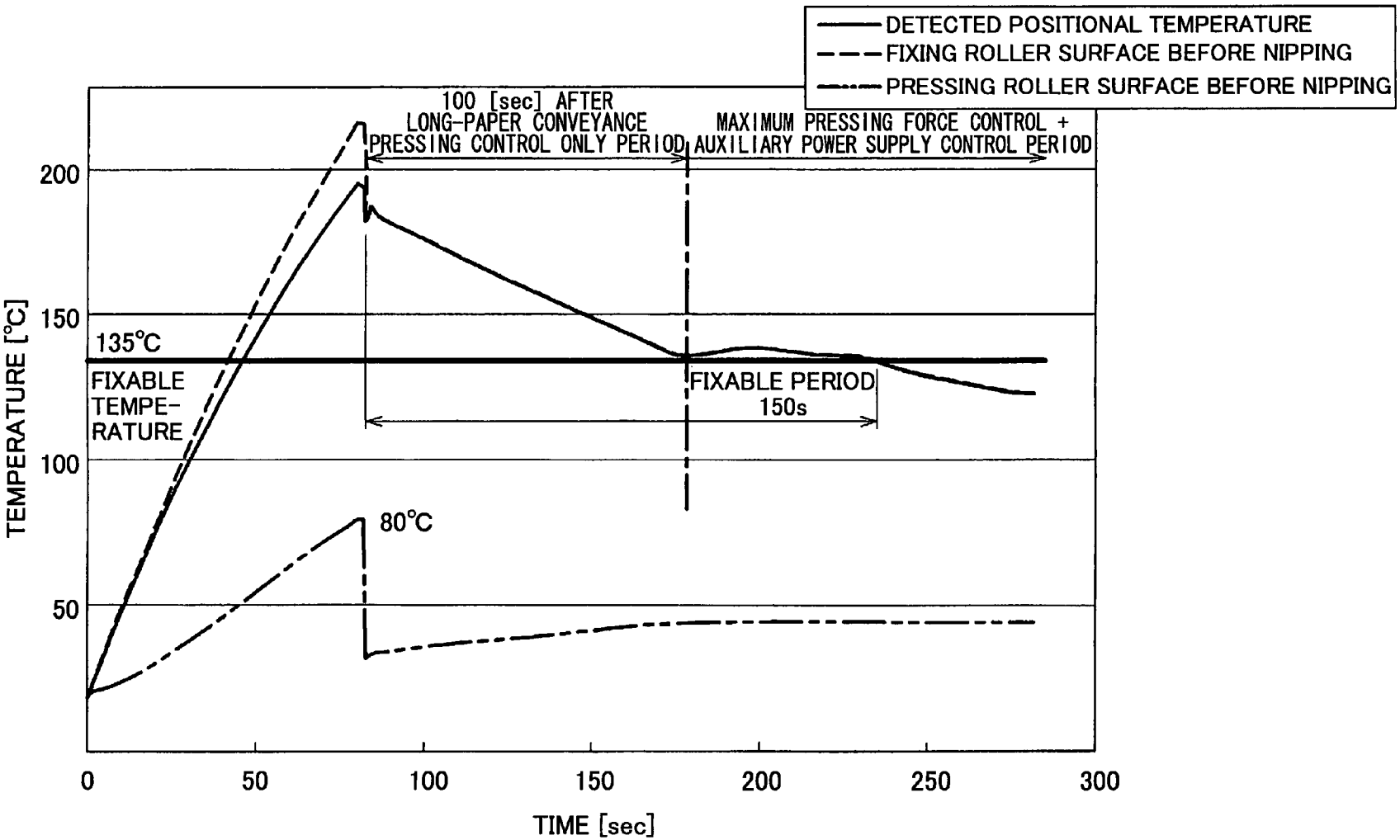
FIG. 13 is another graph showing a relationship between the time [sec.] elapsed after an image forming apparatus is turned on and the surface temperatures of a fixing roller and a pressing roller according to an embodiment of the present invention.

Hence, with the above-described fixing method according to the second embodiment of the present invention, the fixing roller 1010 can have its temperature prevented from decreasing after the surface temperature of the fixing roller 1010 is heated to a predetermined fixation temperature (in this example, 195° C.) by heating the auxiliary heating member 1014 for a certain amount of time, and then, the fixation heat quantity with respect to the toner on the transfer sheet 1045 can be increased by incrementing the nip width step-by-step whenever the surface temperature of the fixing roller 1010 becomes substantially equal to or less than the predetermined fixation temperature. Alternatively, in another example according to the second embodiment of the present invention, the long-paper conveying operation can be started when the surface temperature of the fixing roller 1010 reaches the predetermined fixation temperature and prevent the temperature of the fixing roller 1010 from decreasing by incrementing the nip width, and then, heat the auxiliary heating member 1014 whenever the surface temperature of the fixing roller 1010 becomes substantially equal to or less than the predetermined fixation temperature. The latter example may be more effective in a case where the pressing roller 1012 is being heated. However, with this example, in a case where the pressing roller 1012 is not sufficiently heated when the surface temperature of the fixing roller 1010 has reached the predetermined heating temperature, the heat of the fixing roller 1010 will be absorbed by the pressing roller 1012 via the transfer sheet 1045 when the nip width is increased during the operation of increasing (adjusting) the nip width. Thereby, the heat of the fixing roller 1010 is absorbed by both the transfer sheet 1045 and the pressing roller 1012. As a result, the surface temperature of the fixing roller 1010 rapidly decreases as shown in FIG. 13. Therefore, even if the auxiliary heating member 1014 is charged, the temperature of the fixing roller 1010 tends to quickly fall below 135° C. and the time in which toner can be fixed by the rollers 1010, 1012 is short (in this example, 150 seconds). Therefore, in a case where the pressing roller 1012 is not sufficiently heated, it is preferable to use the former example.

Since both the fixing roller 1010 and the pressing roller 1012 are motionless and the nipping part N does not move at the time of turning on the power of the image forming apparatus 1 or at the time of a standby state, heat is transmitted only at the nipping part N, and the pressing roller 1012 having its heat spreading around its periphery is not sufficiently heated. Taking this into consideration, the control of driving the nip width adjusting part 1032 is executed before executing the control of the heating of the auxiliary heating apparatus 1030 in a usual case. However, in a case where the difference between the temperature of the fixing roller 1010 and the pressing roller 1012 is equal to or greater than a predetermined value according to the detection results by using the first and second temperature detecting parts 1020, 1021, it is determined that the pressing roller 1012 is not sufficiently heated. In this case, the control of driving the nip width adjusting part 1032 is executed after executing the control of the heating of the auxiliary heating apparatus 1030.

Third Embodiment

Next, a fixing apparatus 2029 according to the third embodiment of the present invention is described. The fixing apparatus 2029 of the third embodiment may be mounted to, for example, the image forming apparatus 1 described in the first embodiment of the present invention. The fixing apparatus 2029 has substantially the same configuration as the fixing part (fixing apparatus) 202 described in the first embodiment of the present invention; therefore, detail description regarding the configuration of the fixing apparatus is omitted. The fixing apparatus 2029 includes a fixing roller (fixing member) 2036 and a pressing roller (pressing member) 2037 that presses against the fixing roller 2036. The fixing roller 2036 and the pressing roller 2037 have substantially the same configurations as the fixing roller 20 and the pressing roller 21 of the first embodiment of the present invention; therefore, detailed descriptions of the fixing roller 2036 and the pressing roller 2037 are omitted. The area in which the pressing roller 2037 presses against the fixing roller 2036 for fixing a toner image onto a transfer sheet (recording medium) is referred to as a nipping part N.

In a case of conveying, for example, a recording medium having a long length P (hereinafter referred to as "long paper") between the fixing roller 2036 and the pressing roller 2037 of the fixing apparatus 2029, the heat of the fixing roller 2036 continues to be absorbed by the long paper as the long paper P travels between the fixing roller 2036 and the pressing roller 2037. The longer the time for conveying the long paper P between the fixing roller 2036 and the pressing roller 2037, the greater is the amount of heat absorbed by the long paper P. The temperature of the fixing roller 2036 may become less than the temperature suitable for fixing a toner image onto the long paper P as the long paper P is conveyed between the fixing roller 2036 and the pressing roller 2037.

In order to prevent such reduction of fixing temperature, the fixing apparatus 2029 is provided with a heating part 2039 including a main heating member 2039A that provides heat by receiving power from an AC power supply (main power supply) and an auxiliary heating member 2039B that provides heat by receiving power from an auxiliary power supply, and temperature detecting part 2038 for detecting the surface temperature of the fixing roller 2036. In a case where the temperature detecting part 2038 detects that the temperature (surface temperature) of the fixing roller 2036 (hereinafter referred to as "fixing roller temperature $T_H$") is greater than a temperature required for fixing a toner image onto a recording medium (long paper) (hereinafter referred to as "threshold fixation temperature $T_{lim}$", the fixing roller 2036 is heated by using only the main heating member 2039A being heated by receiving power from the main power supply. In a case where the temperature detecting part 2038 detects that the fixing roller temperature $T_H$ is no greater than the threshold fixation temperature $T_{lim}$, the fixing roller 2036 is heated by using both the main heating member 2039A and the auxiliary heating member 2039B being heated by receiving power from the auxiliary power supply.

Figure 14:
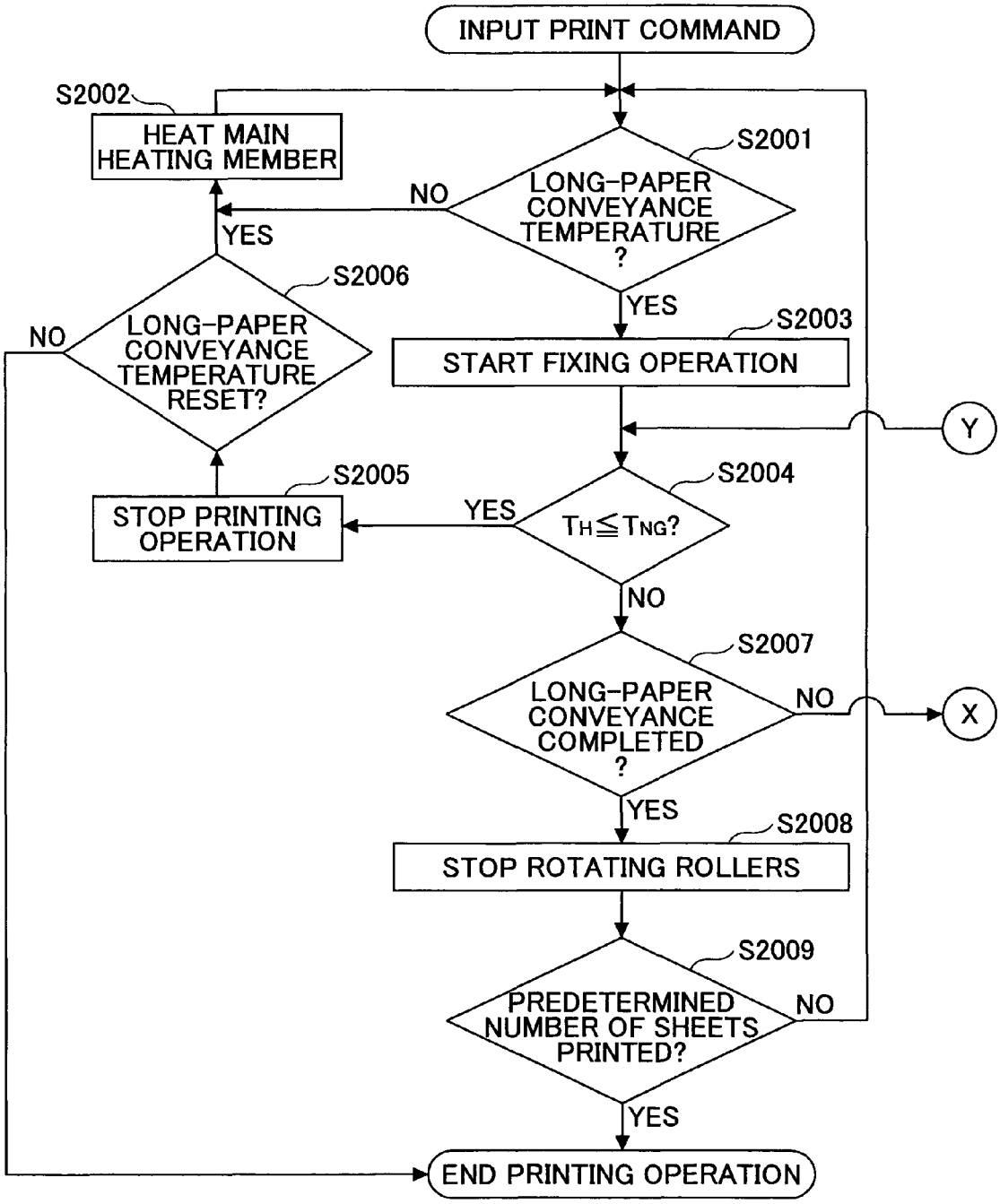
FIGS. 14 and 15 are flowcharts for describing an example of a printing operation executed by using an image forming apparatus including a fixing apparatus according to an embodiment of the present invention.
Figure 15:
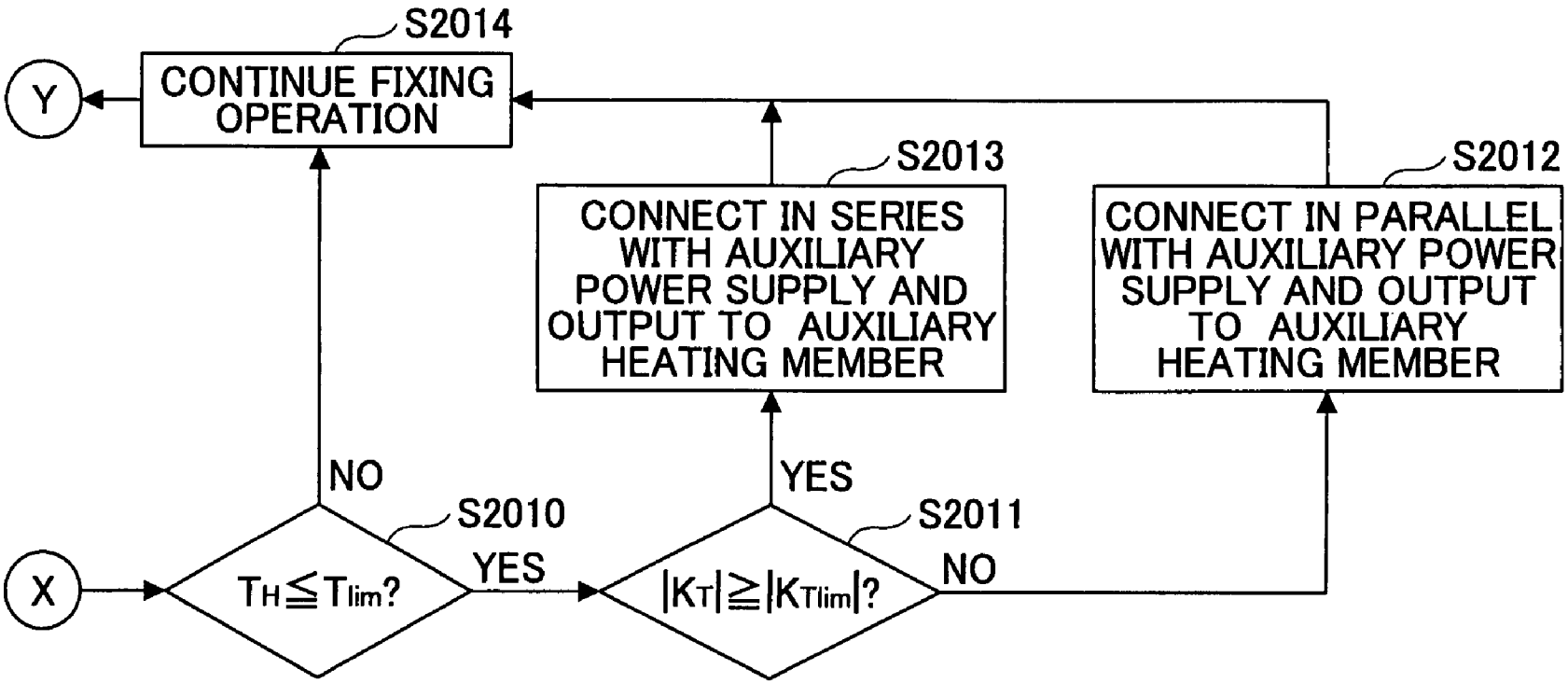

Next, an example of a printing operation executed by using the image forming apparatus 1 including the fixing apparatus 2029 is described with reference to the flowchart shown in FIGS. 14 and 15. First, when the image forming apparatus 1 receives a print command, it is determined whether the temperature detected by the temperature detecting part 2038 is heated to a temperature $T_t$ sufficient for fixing a toner image on the long paper P (hereinafter referred to as "long-paper conveyance temperature $T_t$") (Step S2001). In a case where the fixing roller temperature $T_H$ has reached the long-paper conveyance temperature $T_t$ (Yes in Step 2001), the long paper P is delivered to the area between the fixing roller 2036 and the pressing roller 2037 for starting the operation for fixing a toner image to the long paper P (Step S2003). The operation of fixing the toner image starts when the front end of the long paper P is enters the nipping part N between the fixing roller 2036 and the pressing roller 2037 and ends when the rear end of the long paper P is delivered out from the nipping part N.

In a case where the fixing roller temperature $T_H$ has not reached the long-paper conveyance temperature $T_t$ (No in Step 2001), the fixing roller 2036 is heated by the main heating member 2039A (Step S2002). The Steps S2001 and S2002 are repeated until the fixing roller temperature $T_H$ reaches the long paper conveyance temperature $T_t$. During this heating step of S2002, the auxiliary heating member 2039A is not used, that is, only the main heating member 2039A is used for heating the fixing roller 2036 during Step S2002. The long paper conveyance temperature $T_t$ differs depending on the length of the long paper P. The long paper conveyance temperature $T_t$ becomes higher the greater the length of the long paper P. For example, the long paper conveyance temperature $T_t$ may range from approximately 160° C. to 200° C. Furthermore, the fixing roller temperature $T_H$ refers to the surface temperature of the fixing roller 2036.

After the fixing operation is started, it is determined whether the fixing roller temperature $T_H$ is no greater than a temperature insufficient for fixing a toner image to the long paper P (hereinafter referred to as "insufficient fixation temperature $T_{NG}$", in this example, 140° C.) (Step S2004). In a case where the fixing roller temperature $T_H$ is no greater than the insufficient fixation temperature $T_{NG}$ (Yes in Step S2004) the printing operation is stopped (Step S2005). When the printing operation is stopped, the long paper P being delivered from a roll is cut by one of the roll cutting units 115, 116, the photoconductor 205 stops forming toner images, and the long paper is discharged to the discharge tray 206 or 207. This prevents long paper P having no toner image fixed thereto from being continuously discharged from the image forming apparatus 1. After the printing operation is stopped, a message is displayed on the operating part (e.g. control panel) for prompting the user to reset the long-paper conveyance temperature $T_t$ (for example, resetting to a higher temperature. In a case where the user resets the long-paper conveyance temperature $T_t$ to a higher temperature (Yes in Step S2006), the step of heating the main heating member is started (Step S2002). Then, Step S2001 is restarted. In a case where the user does not reset the long-paper conveyance temperature $T_t$ (No in Step S2006), the printing operation is terminated.

Meanwhile, in a case where the fixing roller temperature $T_H$ is greater than the insufficient fixation temperature $T_{NG}$ (No in Step S2004), the printing operation proceeds to Step S2007. In Step S2007, a sensor (not shown) determines whether the rear end of the long paper P is delivered out from the nipping part N between the fixing roller 2036 and the pressing roller 2037. That is, it is determined whether the long paper P has passed through the nipping part N between the fixing roller 2036 and the pressing roller 2037 for determining the completion of the long-paper conveyance operation. In a case where it is determined that the long-paper conveyance operation is completed and that the fixing operation is completed (Yes in Step S2007), the rotation of the fixing rollers 2036 and the pressing roller 2037 is temporarily stopped (Step S2008). Then, it is determined whether a desired number of sheets are printed (Step S2009). In a case where the printing of the desired number of sheets is not completed, the printing operation returns to Step S2001. In a case where the printing of the desired number of sheets is completed, the printing operation is terminated.

In a case where the rear end of long paper P is not yet discharged from the nipping part N between the fixing roller 2036 and the pressing roller 2037, that is, when the fixing operation of toner image unfinished (No in Step S2007), it is determined whether the fixing roller temperature $T_H$ is no greater than the threshold fixation temperature $T_{lim}$ (for example, 150° C.) (Step S2010). In a case where the fixing roller temperature $T_H$ is determined to be greater than the threshold fixation temperature $T_{lim}$ (No in Step S2010), the fixing operation is continued while heating the fixing roller 2036 using the main heating member 2039A and without use of the auxiliary heating member 2039B (Step S2014). In a case where the fixing roller temperature $T_H$ is determined to be no greater than the threshold fixation temperature $T_{lim}$ (Yes in Step S2010), the fixing roller 2036 is heated by using both the main heating member 2039A and the auxiliary heating member 2039B receiving power from the auxiliary power supply. Thereby, the fixing roller 2036 can be heated with a sufficient heat quantity so that the fixing roller temperature $T_H$ can be maintained at a temperature suitable for fixing a toner image onto the long paper P.

As described above, the long paper P is conveyed between the fixing roller 2036 and the pressing roller 2037 while the fixing roller 2036 is initially heated only with the main heating member 2039A. In a case where the fixing roller temperature $T_H$ detected by the temperature detecting part 2038 is no greater than the threshold fixation temperature $T_{lim}$, power is supplied from the auxiliary power supply to the auxiliary heating member 2039B for enabling the fixing roller 2036 to be heated also with the auxiliary heating member 2039B.

The case where the fixing roller temperature $T_H$ becomes no greater than the threshold fixation temperature $T_{lim}$ can be further divided two cases. The first case is where the fixing roller temperature $T_H$ abruptly becomes no greater than the threshold fixation temperature $T_{lim}$, and the second case is where the fixing roller temperature $T_H$ gradually becomes no greater than the threshold fixation temperature $T_{lim}$. Compared to the second case, the first case is more likely to cause the fixing roller temperature $T_H$ to become lower than a temperature suitable for fixing a toner image to the long paper unless the fixing roller 2036 is heated with a considerable heat quantity.

Therefore, the fixing apparatus 2029 according to the third embodiment of the present invention includes one or more additional auxiliary power supplies (auxiliary power supplying units) that can be switched between parallel connection and serial connection. Furthermore, the fixing apparatus 2029 according to the third embodiment of the present invention also includes a calculating part for calculating the tilt of the changes of fixing roller temperature $T_H$ (the amount of change of the fixing roller temperature $T_H$ per a predetermined time period) $dT_H/dt=K_T$.

Accordingly, in Step S2011, it is determined whether the absolute value of the tilt $|K_T|$ is no less than a predetermined threshold tilt $|K_{Tlim}|$. In a case where the absolute value of the tilt $|K_T|$ is less than the threshold tilt $|K_{Tlim}|$ (No in Step S2011), an auxiliary power supply controlling part 2048 (See FIG. 20) connects plural auxiliary power supplying units in parallel for enabling the parallel connected plural auxiliary power supplying units to supply power to the auxiliary heating member 2039B (Step S2012). While heating the fixing roller 2036 with the main heating member 2039A and the auxiliary heating member 2039B by supplying power to the main heating member 2039A and the auxiliary heating member 2039B, the toner fixing operation of Step S2014 is continued. In a case where the absolute value of the tilt $|K_T|$ is no less than the threshold tilt $|K_{Tlim}|$ (Yes in Step S2011), the auxiliary power supply controlling part 2048 connects the plural auxiliary power supplying units in series for enabling the serially connected plural auxiliary power supplying units to supply power to the auxiliary heating member 2039B (Step S2013). While heating the fixing roller 2036 with the main heating member 2039A and the auxiliary heating member 2039B by supplying power to the main heating member 2039A and the auxiliary heating member 2039B, the toner fixing operation of Step S2014 is continued. By connecting plural auxiliary power supplying units in series, a greater amount of power can be supplied to the auxiliary heating member 2039B compared to connecting the plural auxiliary power supplying units in parallel. Therefore, a large heat quantity can be provided to the fixing roller 36 sufficient for a case where there is an acute drop (large tilt) in the temperature of the fixing roller 2036. Thereby, the fixing roller temperature $T_H$ can be prevented from being reduced to a temperature insufficient for fixing a toner image.

Hence, the heating part 2039 included in the fixing apparatus 2029 according to the third embodiment of the present invention is provided with the main heating member 2039A receiving power from a main power supply and the auxiliary heating member 2039B receiving power from plural auxiliary power supplying units that can be switched between serial connection and parallel connection. Thus, in a case where the fixing roller temperature falls to a temperature no greater than the threshold fixation temperature when the long paper P is conveyed between the fixing roller 2036 and the pressing roller 2037 while heating the fixing roller 2036 only with the main heating member 2039A, auxiliary power supply controlling part 2048 (described in further detail below) connects the plural auxiliary power supplying units in series when the absolute value of the tilt $|K_T|$ is no less than the threshold tilt $|K_{Tlim}|$ and connects the plural auxiliary power supplying units in parallel when the absolute value of the tilt $|K_T|$ is less than the threshold tilt $|K_{Tlim}|$. Accordingly, the auxiliary heating member 2039B is heated by serially connected plural auxiliary power supplying units when the absolute value of the tilt $|K_T|$ is no less than the threshold tilt $|K_{Tlim}|$ and is heated by parallel connected plural auxiliary power supplying units when the absolute value of the tilt $|K_T|$ is less than the threshold tilt $|K_{Tlim}|$.

Therefore, the fixing apparatus 2039 having the above-described configuration can prevent the fixing roller temperature $T_H$ from falling below a temperature suitable for fixing toner images during the long-paper conveyance operation without having to use a fixing roller having large heat capacity.

It is to be noted that the auxiliary power supply (auxiliary power supplying unit) may preferably be, for example, an electric double layer capacitor capable of charging and discharging or a fuel cell which can be reused by refueling.

Figure 16:
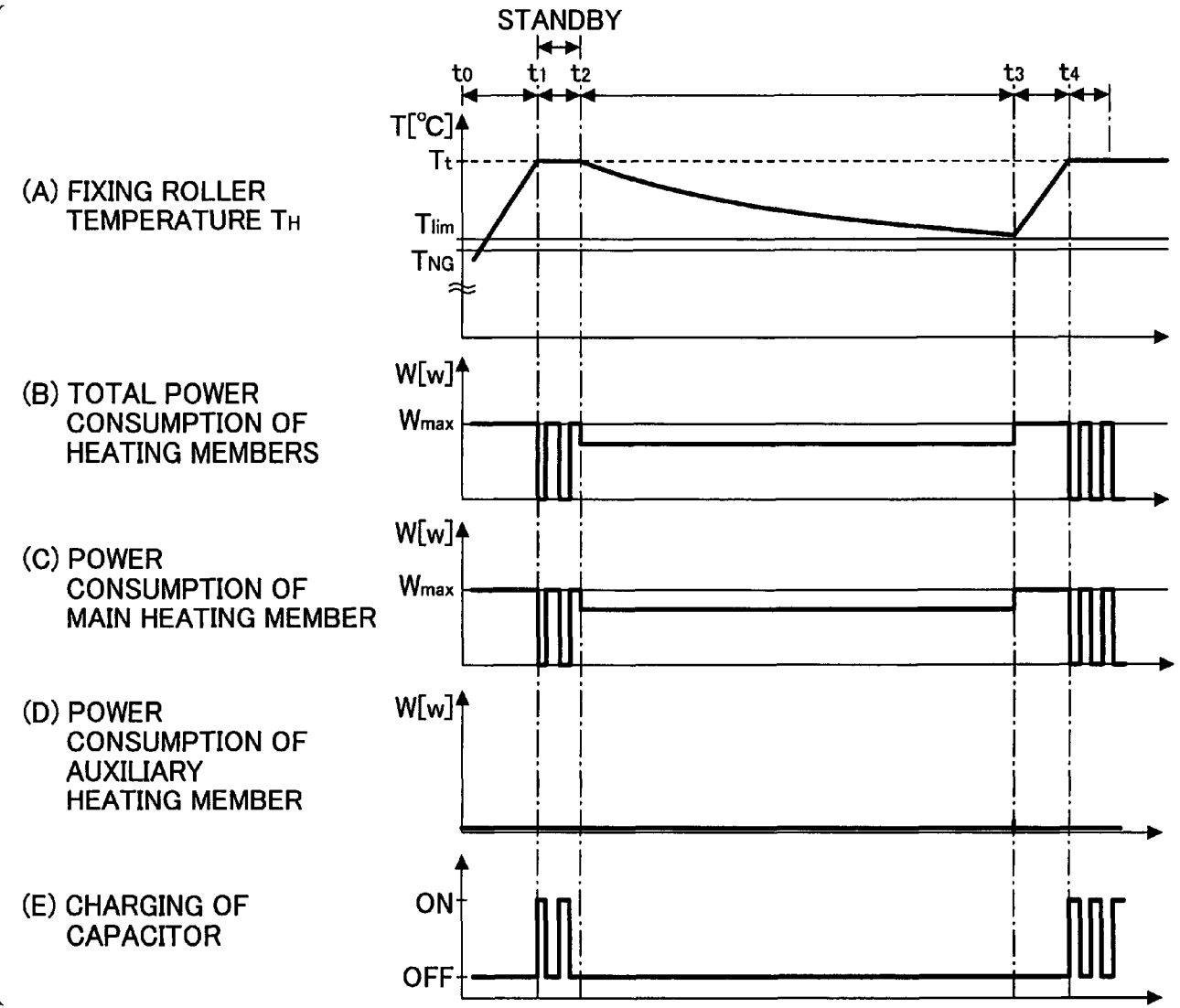
FIG. 16 is a timing chart for describing an operation of an image forming apparatus in a case where an electric double layer capacitor is used as an auxiliary power supply according to an embodiment of the present invention.
Figure 17:
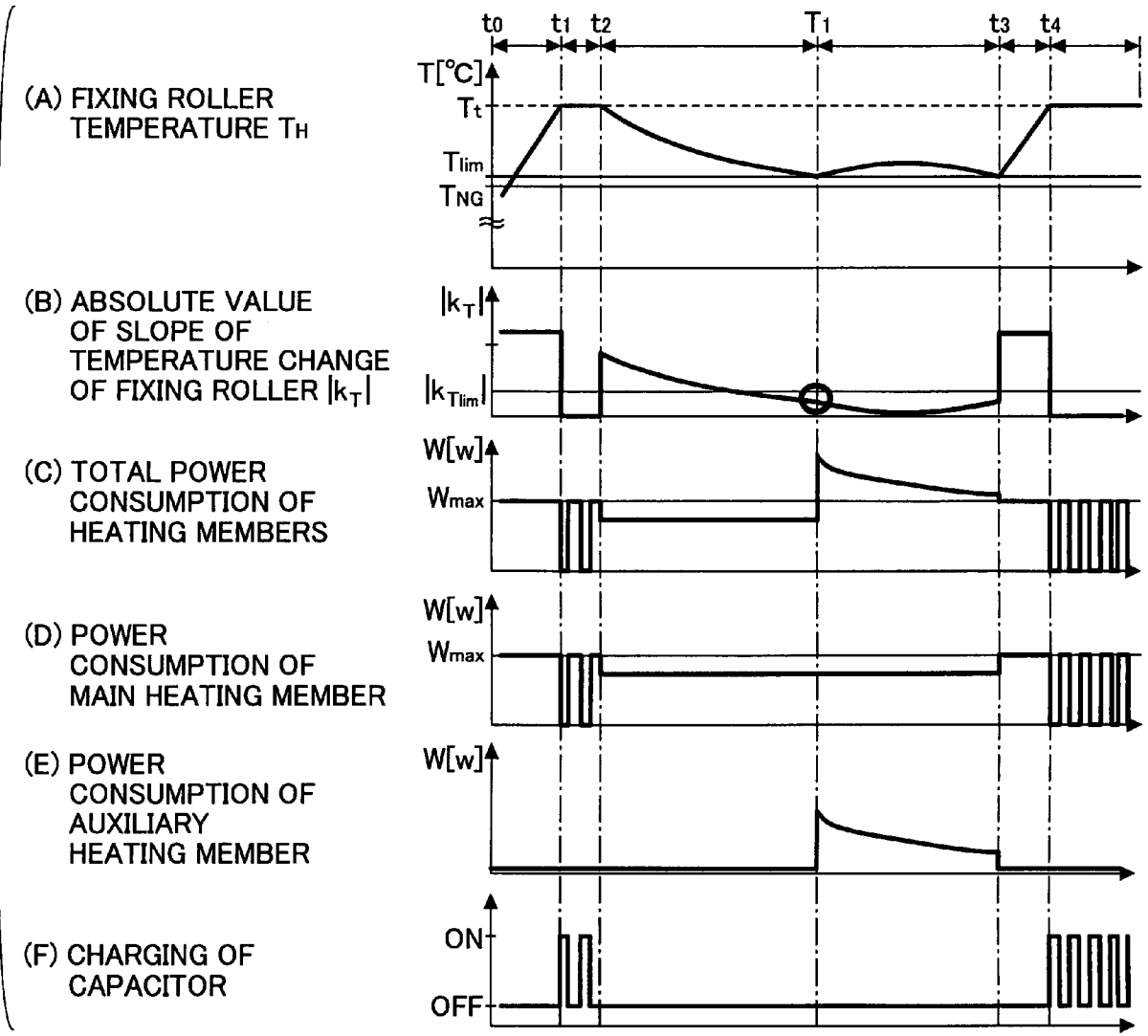
FIG. 17 is a timing chart for describing another operation of an image forming apparatus in a case where an electric double layer capacitor is used as an auxiliary power supply according to an embodiment of the present invention.
Figure 18:
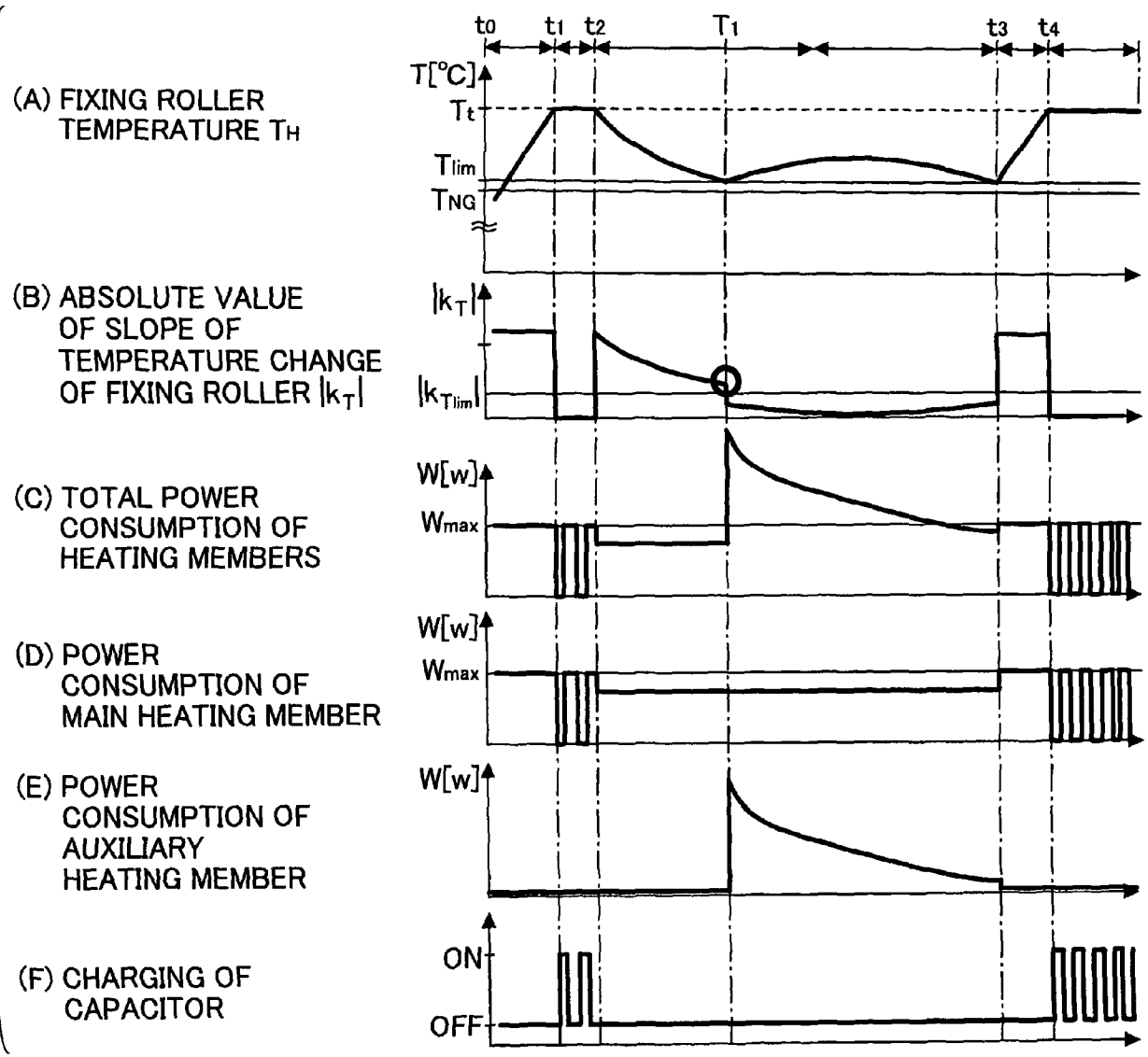
FIG. 18 is another timing chart for describing another operation of an image forming apparatus in a case where an electric double layer capacitor is used as an auxiliary power supply according to an embodiment of the present invention.

FIGS. 16-18 show timing charts when using an electric double layer capacitor as the auxiliary power source of the fixing apparatus 2029. FIG. 16 shows a case of executing a printing operation using only the main heating member 2039A for heating the fixing roller 2036. In FIG. 16, the supplying of power from the main power supply (AC power supply) to the main heating member 2039A is started at timing to. Accordingly, the main heating member 2039A is heated, to thereby heat the fixing roller 2036. In (A) of FIG. 16, the starting operation of the fixing apparatus 2029 is completed once the fixing roller temperature $T_H$ reaches the above-described long-paper conveyance temperature $T_t$ at timing $t_1$. Although the fixing roller 2036 is heated without using the auxiliary heating member 2039B in the starting operation for this example shown in FIG. 16, the starting operation of the fixing apparatus 2029 may be shortened by heating the auxiliary heating member 2039B by having the auxiliary power supply (in this example, electric double layer capacitor) supply power to the auxiliary heating member 2039B.

After the starting operation of the fixing apparatus 2029 is completed, the power supply to the main heating member 2039A is turned on and off for enabling the fixing roller 2036 to maintain the fixing roller temperature $T_H$ as shown in (C) of FIG. 16. This is a standby state of the fixing apparatus 2029. In this standby state, a voltage sensor (not shown) detects the voltage of the electric double layer capacitor and determines whether there is space for charging the electric double layer capacitor. In a case where there is space remaining for charging the electric double layer capacitor, the electric double layer capacitor is charged when power is not supplied from the main power supply to the main heating member 2039A ((C) and (E) of FIG. 16). Accordingly, the electric double layer capacitor can be efficiently charged for enabling the electric double layer capacitor to use a large amount of power.

It is to be noted that the fixing roller 2036 and the pressing roller 2037 are not rotated during the starting operation and during the standby state.

The fixing operation (long-paper conveyance operation) is started at timing $t_2$ shown in FIG. 16, in which the fixing roller 2036 and the pressing roller 2037 begin rotating and the long paper P begins to enter the nipping part N between the fixing roller 2036 and the pressing roller 2037. As shown in (C) of FIG. 16, the AC power consumption of the main heating member 2039A during the fixing operation is lower than that during the starting operation since the AC power of the main power supply is converted into DC power and used for rotating the fixing roller 2036 when the fixing operation is started.

As the fixing operation is started at timing $t_2$, the long paper P begins to absorb the heat of the fixing roller 2036. Although (A) of FIG. 16 shows a gradual decrease of the fixing roller temperature TH, the fixing operation is completed at timing $t_3$ without the fixing roller temperature $T_H$ becoming no greater than the threshold fixation temperature $T_{lim}$. That is, at timing $t_3$, the rear end of the long paper P is conveyed out from the nipping part N between the fixing roller 2036 and the pressing roller 2037. Once the long paper is delivered out from the nipping part N, the rotation of the fixing roller 2036 and the pressing roller 2037 is stopped.

After the fixing operation is completed, power is supplied to the main heating member 2039A until the fixing roller temperature $T_H$ rises to the long-paper conveyance temperature $T_t$ at timing t4 ((A) and (C) of FIG. 16). In a subsequent standby state, the power supply to the main heating member 2039A is turned on and off for enabling the fixing roller 2036 to maintain the fixing roller temperature $T_H$ as shown in (C) of FIG. 16. In a case where there is space remaining for charging the electric double layer capacitor, the electric double layer capacitor is charged when power is not supplied from the main power supply to the main heating member 2039A ((C) and (E) of FIG. 16).

Furthermore, in the period between timing $t_3$ and timing $t_4$, power may also be supplied from the electric double layer capacitor to the auxiliary heating member 2039B, so that the fixing roller 2036 can be heated by both heating members 2039A and 2039B. Thereby, the timing for increasing the fixing roller temperature TH to the long-paper conveyance temperature $T_t$ can be shortened.

In FIG. 17, operations during the period between timing t0 and timing t2 and the period after timing t3 are the same as those described with FIG. 16. The difference is that the fixing roller temperature $T_H$ becomes no greater than the threshold fixation temperature $T_{lim}$ at a timing $T_1$. As shown in (B) of FIG. 17, since the absolute value of the tilt of the temperature change of the fixing roller 2036 $|K_T|$ is less than the threshold tilt $|K_{Tlim}|$, plural electric double layer capacitors are switched to parallel connection. Accordingly, the fixing roller 2036 is heated by the main heating member 2039A receiving power from the main power supply and the auxiliary heating member 2039B receiving power from the parallel connected electric double layer capacitors. Therefore, as shown in (C), (D), and (E) of FIG. 17, the power consumption of the heating part 2039 (i.e. total power consumption of the main heating member 2039A and the auxiliary heating member 2039B) discontinuously increases at timing $T_1$. Since the output of the electric double layer capacitor decreases as it continues to discharge electricity, the total power consumption of the heating part 2039 also gradually decreases at timing T1 ((C) and (E) of FIG. 17).

As shown in (E) and (F) of FIG. 17, the electric double layer capacitor is not charged by the main power supply (AC power supply) during the period where power is being supplied from the electric double layer power supply to the auxiliary heating member 2039B. Therefore, since the use of the power resources of the main power supply can be concentrated on the main heating member 2039A, the fixing roller 2036 can be efficiently heated to a suitable temperature.

As shown in (A) and (B) of FIG. 18, when the fixing roller temperature $T_H$ becomes a temperature equal to the threshold fixation temperature $T_{lim}$, the absolute value of tilt $|K_T|$ of the temperature change of the fixing roller 2036 becomes no less than the threshold tilt $|K_{Tlim}|$ at timing T1. Therefore, in this case, the plural electric double layer capacitors are connected in series. Accordingly, a large amount of power can be supplied from the serially connected electric double layer capacitors to the auxiliary heating member 2039B while AC power is supplied from the main power supply to the main heating member 2039A. As shown in (E) of FIG. 18, the power consumption of the auxiliary heating member 2039B is greater than that shown in (E) of FIG. 17 since the power of the auxiliary heating member 2039B is supplied from the serially connected auxiliary heating member 2039B. Moreover, as shown in (C) of FIG. 18, the power consumption of the heating part 2039 is greater than that shown in (C) of FIG. 17. Hence, more power can be supplied to the auxiliary heating member 39B compared to a case of supplying power from plural electric double layer capacitors connected in parallel. Therefore, the fixing roller 2036 can be rapidly heated to a suitable temperature. Other than the operations described above, the operations described with FIG. 18 are basically the same as the operations described with FIG. 17.

Figure 19:
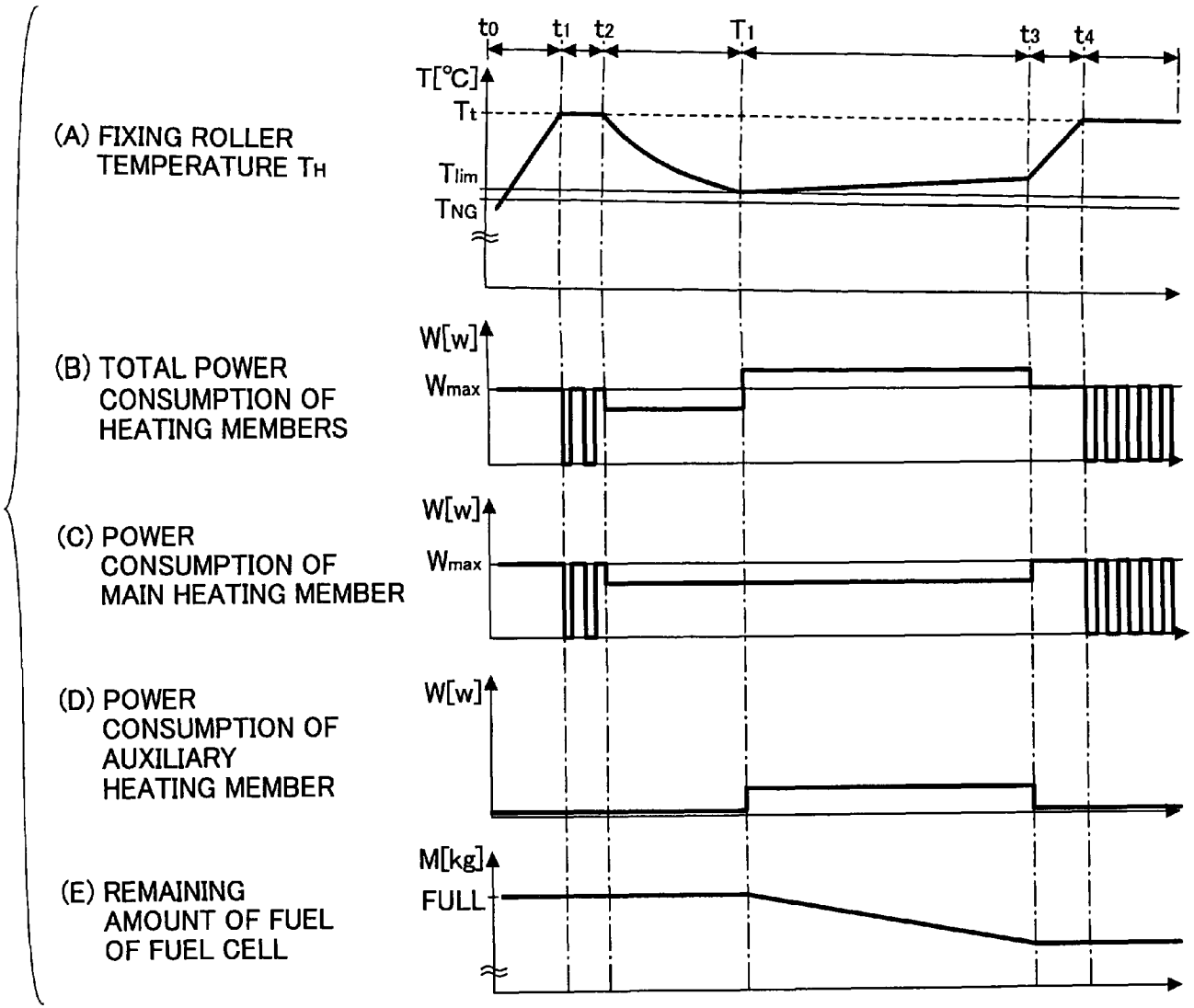
FIG. 19 is another timing chart for describing an operation of an image forming apparatus in a case where a fuel cell is used as an auxiliary power supply according to an embodiment of the present invention.

FIG. 19 shows timing charts when using a fuel cell as the auxiliary power source of the fixing apparatus 2029. In this example shown in FIG. 19, when the fixing roller temperature $T_H$ becomes a temperature no greater than the threshold fixation temperature $T_{lim}$, the absolute value of tilt $|K_T|$ of the temperature change of the fixing roller 2036 becomes less than the threshold tilt $|K_{Tlim}|$ at timing $T_1$. Accordingly, since the absolute value of the tilt of the temperature change of the fixing roller 2036 $|K_T|$ is less than the threshold tilt $|K_{Tlim}|$, plural electric double layer capacitors are switched to parallel connection. Accordingly, the fixing roller 2036 is heated by the main heating member 2039A receiving power from the main power supply and the auxiliary heating member 2039B receiving power from the parallel connected electric double layer capacitors. As shown in (B), (C), and (D) of FIG. 19, the power consumption of the heating part 2039 is the total power consumption of the main heating member 2039A and the auxiliary heating member 2039B.

In this example, the remaining amount of fuel is to be monitored since the amount of fuel decreases as electricity is discharged from the fuel cell (as shown in (E) of FIG. 19). Therefore, it is preferable to display the remaining amount of fuel on the operating part for communicating the remaining amount of fuel. Furthermore, it is preferable for the fuel cell to be configured as, for example, a cartridge type fuel cell that allows the fuel cell to be easily exchanged when the user finds that the amount of fuel is small. Therefore, it is preferable to provide the fuel cell or the fixing apparatus with a remaining fuel amount detecting part for detecting the amount of fuel remaining in the fuel cell, a remaining fuel amount display part for displaying the amount of fuel remaining in the fuel cell, and a fuel exchange notifying part for notifying the user that the fuel cell is to be exchanged due to lack of fuel remaining in the fuel cell.

Next, an exemplary configuration of the auxiliary power supply and the auxiliary power supply controlling part according to an embodiment of the present invention is described.

FIGS. 20-23 show a circuit diagram of an auxiliary power supply controlling part 2048 for switching the connection of two electric double layer capacitors between parallel connection and serial connection and supplying power from the electric double layer capacitors C1, C2 to the auxiliary heating member 2039. Each electric double layer capacitor C1, C2 includes plural capacitor cells. A switch $S_5$ switches on and off the supply of power from the main power source 2045 to the main heating member 2039A. A charger 2046 is for charging the two electric double layer capacitors C1, C2 from the power supplied from the main power supply 2045. Furthermore, the switch S2 switches between the power supplied from the main power supply 2045 for charging the electric double layer capacitors C1, C2 and the power supplied from the electric double layer capacitors C1, C2 for heating the auxiliary heating member 2039B. The temperature detecting part 2038 (e.g. thermistor) contacting the surface of the fixing roller 2036 outputs detection signals to the CPU 2047 in accordance with the temperature detected from the fixing roller 2036. Based on the detections signals, the CPU 2047 controls the switching of each switch $S_1$-$S_5$.

Figure 20:
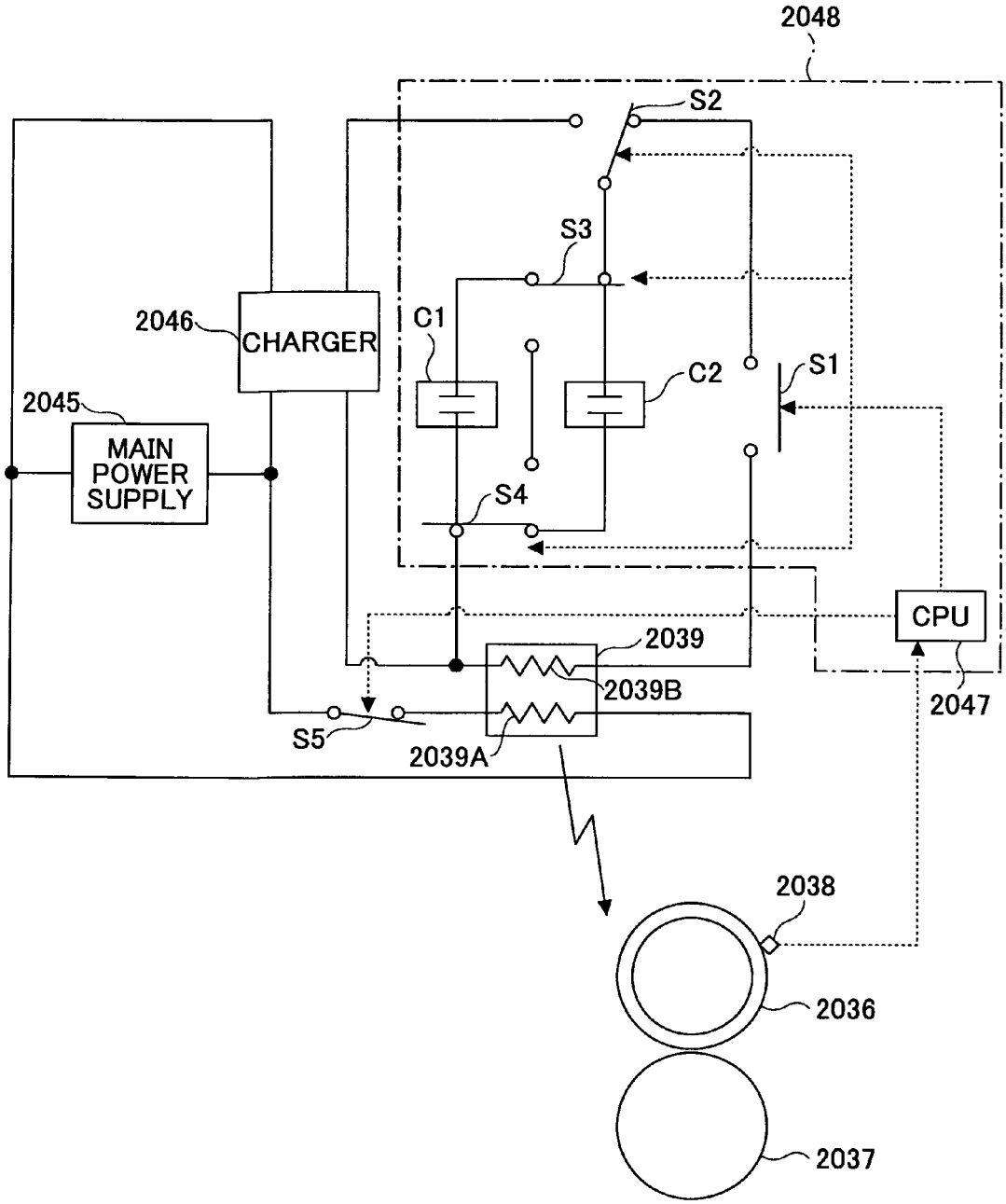
FIG. 20 is a circuit diagram showing a main power supply, an auxiliary power supply, and a fixing apparatus including an auxiliary power supply controlling part according to an embodiment of the present invention.

FIG. 20 shows the auxiliary power supply controlling part 2048 in a situation where the main switch S5 is closed so that power is supplied from the main power supply 2045 to the main heating member 2039A for heating the main heating member 2039A. In this state, the switches $S_3$, $S_4$ switch the connection of the electric double layer capacitors C1, C2 to parallel connection. Although the switch $S_2$ is switched towards the switch $S_1$, no power is supplied from the electric double layer capacitors C1, C2 to the auxiliary heating member 2039B since the switch $S_1$ is switched off.

Figure 21:
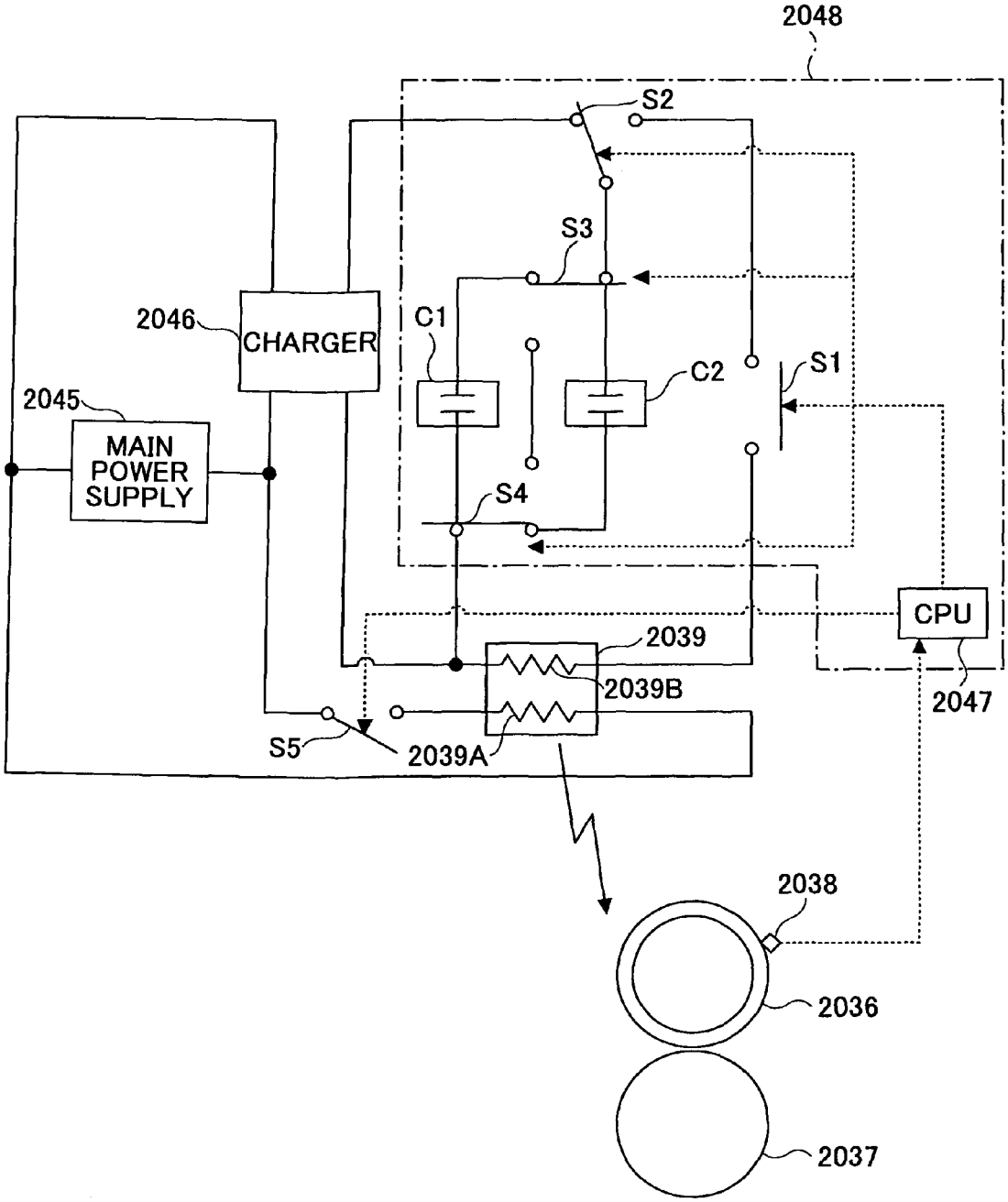
FIG. 21 is a circuit diagram showing a main power supply, an auxiliary power supply, and a fixing apparatus including an auxiliary power supply controlling part according to an embodiment of the present invention.

FIG. 21 shows the auxiliary power supply controlling part 2048 in a situation of charging the electric double layer capacitors C1, C2. In this state, the main switch S5 is switched off. Furthermore, the supply of power from the main power supply 2045 to the main heating member 2039A is disconnected. Furthermore, in this state, the switch S2 is switched towards the charger 2046 for allowing the charger 2045 to charge the electric double layer capacitors C1, C2 with power from the main power supply 2045.

Figure 22:
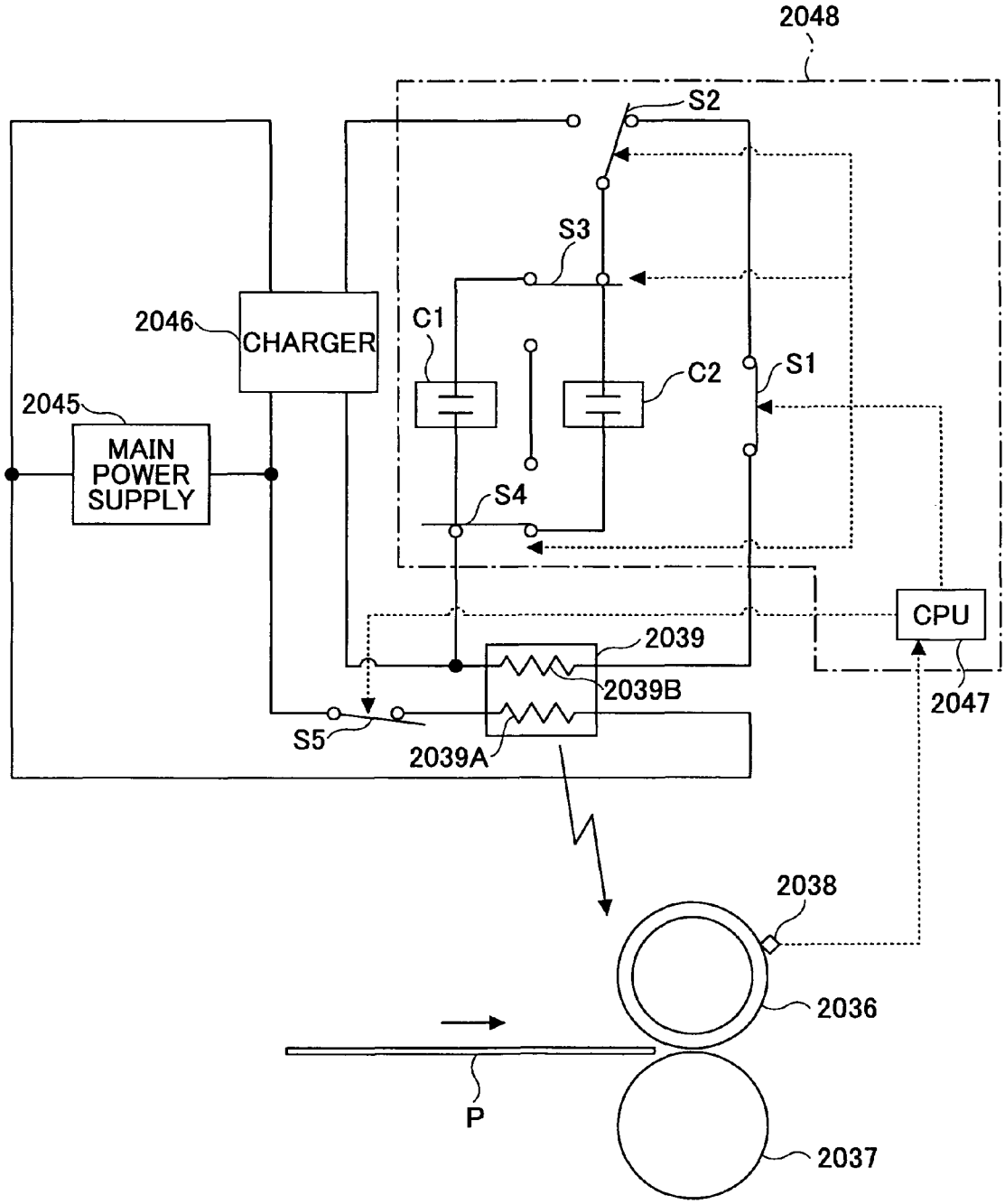
FIG. 22 is a circuit diagram showing a main power supply, an auxiliary power supply, and a fixing apparatus including an auxiliary power supply controlling part according to an embodiment of the present invention.

FIG. 22 shows the auxiliary power supply controlling part 2048 in a situation where the fixing roller temperature $T_H$ (detected by the temperature detecting part 2038) becomes a temperature no greater than the threshold fixation temperature $T_{lim}$ and the absolute value $|K_T|$ of the tilt of the temperature change of the fixing roller 2036 becomes less than the threshold tilt $|K_{Tlim}|$ during execution of the fixing operation while heating the fixing roller 2036 by using the main heating member 2039A. In this state, the main switch $S_5$ is switched on for allowing power to be supplied from the main power source 2045 to the main heating member 2039A. Furthermore, while the electric double layer capacitors C1, C2 are connected in parallel, the switch $S_2$ is switched toward the switch $S_1$ and the switch $S_1$ is closed. Accordingly, both heating members 2039A and 2039B are heated by supplying power from the main power supply 2045 and from the electric double layer capacitors C1, C2 connected in parallel.

Figure 23:
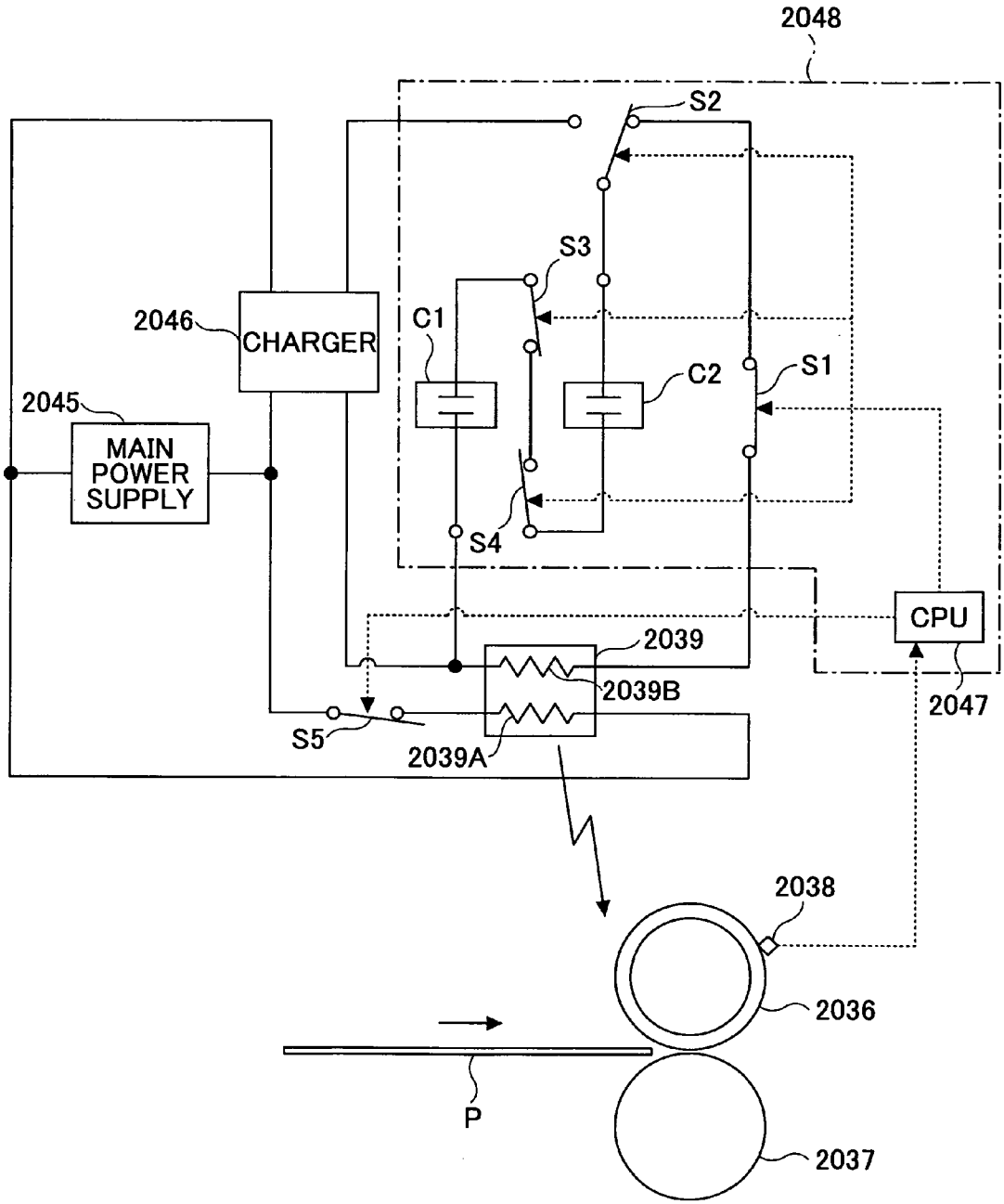
FIG. 23 is a circuit diagram showing a main power supply, an auxiliary power supply, and a fixing apparatus including an auxiliary power supply controlling part according to an embodiment of the present invention.

FIG. 23 shows the auxiliary power supply controlling part 2048 in a situation where the fixing roller temperature $T_H$ (detected by the temperature detecting part 2038) becomes a temperature no greater than the threshold fixation temperature $T_{lim}$ and the absolute value $|K_T|$ of the tilt of the temperature change of the fixing roller 2036 becomes no less than the threshold tilt $|K_{Tlim}|$ during execution of the fixing operation while heating the fixing roller 2036 by using the main heating member 2039A. In this state, the switches $S_3$, $S_4$ switch the connection of the electric double layer capacitors C1, C2 to serial connection. The connection of the other parts (e.g. switch $S_2$, $S_5$) is the same as that of FIG. 22. Accordingly, both heating members 2039A and 2039B are heated by supplying power from the main power supply 2045 and from the electric double layer capacitors C1, C2 connected in series.

Figure 24:
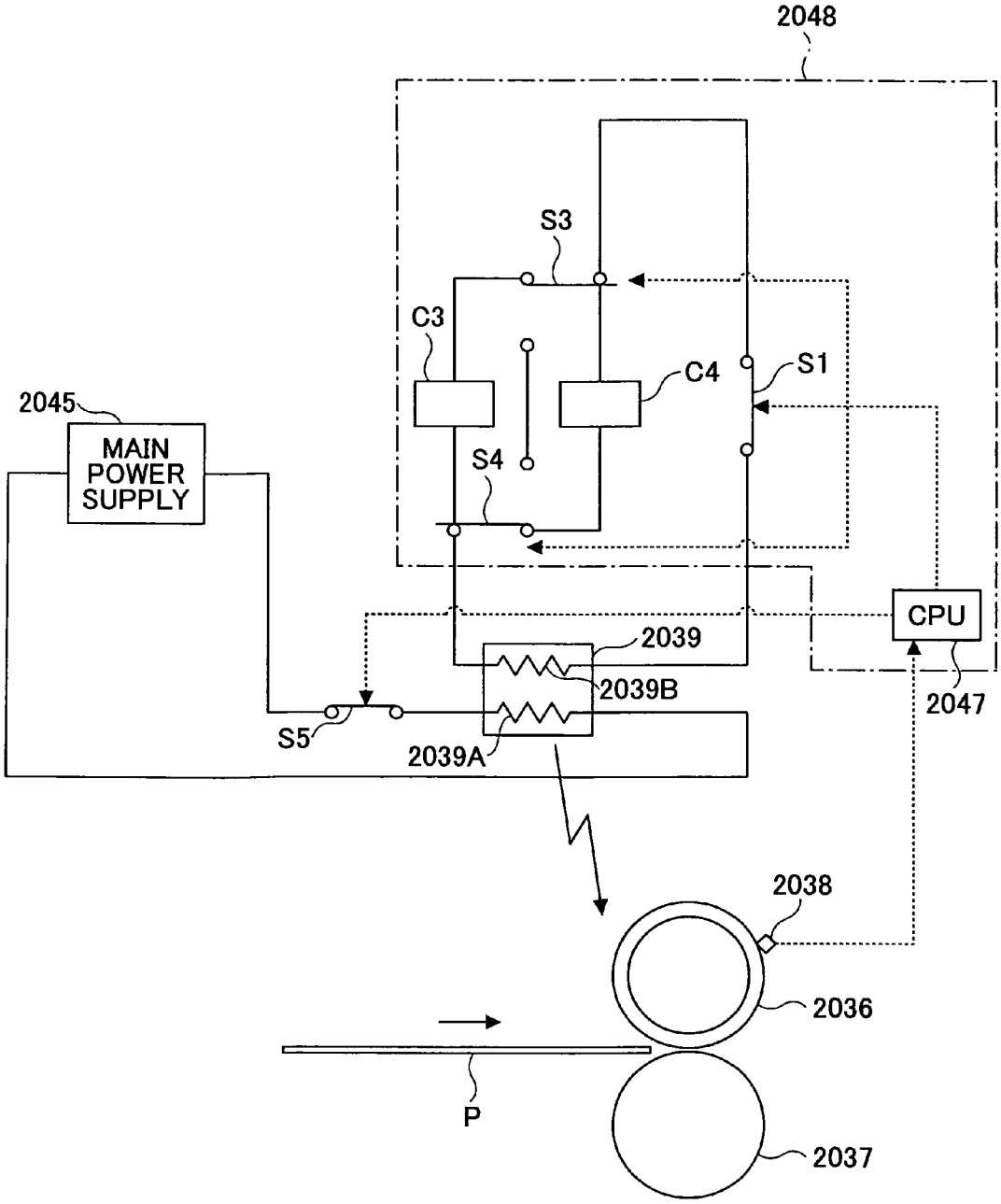
FIG. 24 is a circuit diagram showing a main power supply, an auxiliary power supply, and a fixing apparatus including an auxiliary power supply controlling part according to an embodiment of the present invention.

FIG. 24 shows the auxiliary power supply controlling part 2048 in a case where two fuel cells C3, C4 are used as the auxiliary power supplies (auxiliary power supplying units). In this configuration of the fixing apparatus 2029 including the auxiliary power supply controlling part 2048, the charger 2046 shown in FIGS. 20-26 is not included. FIG. 24 shows a state where the switches S1, S5 are closed and the fuel cells C3, C4 are connected in parallel, so that power can be supplied to the main heating member 2039A and the auxiliary heating member 2039B from the main power source 2045 and the fuel cells C3, C4, respectively. In this case, the switch. $S_1$ is opened when supplying power from the main power supply 2045 to the main heating member 2039A and not supplying power from the fuel cells C3, C4 to the auxiliary heating member 2039B. Furthermore, the switches S3, S4 switch the connection of the fuel cells C3, C4 in the same manner as FIG. 23 when supplying power from the fuel cells C3, C4 connected in series.

By assembling the auxiliary power supply controlling part 2048 (including the CPU 2047) and the auxiliary power supplies (auxiliary power supplying units) into a united body, an auxiliary power apparatus can be obtained. In the auxiliary power apparatus, plural auxiliary power supplying units can be switch-ably connected in series and in parallel. More specifically, in a case where the temperature of the fixing roller (fixing member) becomes a temperature no greater than a predetermined threshold fixation temperature, the plural auxiliary power supplying units are connected in series when the absolute value of the tilt of the temperature change of the fixing roller (fixing member) becomes no less than a predetermined tilt threshold, so that the auxiliary heating member can be heated by the serially connected plural auxiliary power supplying units. In a case where the temperature of the fixing roller (fixing member) becomes a temperature no greater than a predetermined threshold fixation temperature, the plural auxiliary power supplying units are connected in parallel when the absolute value of the tilt of the temperature change of the fixing roller (fixing member) becomes less than the predetermined tilt threshold, so that the auxiliary heating member can be heated by the parallel connected plural auxiliary power supplying units.

It is to be noted that the fixing apparatus of the present invention is not to be limited to the above-described configuration including the fixing roller (fixing member) 2036 and the pressing roller (pressing member) 2037. For example, in the fixing apparatus of the present invention, a fixing belt wound around plural support rollers and driven by said support rollers may be alternatively used as the fixing member for fixing the toner image on a recording medium, or a pressure belt may be alternatively used as the pressing member for pressing against the fixing member.

Further, the present invention is not limited to these embodiments, but variations and modifications may be made without departing from the scope of the present invention.

The present application is based on Japanese Priority Application Nos. 2005-248661, 2005-269704, and 2005-318889 filed on Aug. 30, 2005, Sep. 16, 2005, and Nov. 1, 2005, respectively, with the Japanese Patent Office, the entire contents of which are hereby incorporated by reference.

What is claimed is:

1. An image forming apparatus including a fixing apparatus for fixing a toner image onto a single recording medium by applying pressure and heat to toner provided on the surface of the recording medium, the fixing apparatus comprising:

a fixing member;

a pressing member configured to press against the fixing member;

a temperature detecting part configured to detect a temperature of the fixing member;

a heating member including a main heating member and an auxiliary heating member configured to heat the fixing member, the main heating member being connected to be heated by obtaining power from a main power supply, the auxiliary heating member being connected to be heated by obtaining power from an auxiliary power supply, wherein in a case where the temperature detecting part detects that the temperature of the fixing member being heated by the main heating member is no greater than a threshold fixation temperature, the heating member is configured to heat the auxiliary heating member when the toner image is in the middle of being fixed onto the single recording medium, wherein heating member is configured to heat the main heating member from before beginning heating the auxiliary heating member until after stopping heating the auxiliary heating member, and wherein the heating member is configured to increase power supplied from the main power supply to the main heater immediately after completion of fixing the toner image onto the single recording medium.

2. The image forming apparatus as claimed in claim 1, further comprising:

a calculating part for calculating a slope of the changes of the temperature of the fixing roller temperature; and an auxiliary power supply controlling part configured to control electric connections of a plurality of auxiliary power supply units included in the auxiliary power supply;

wherein the plural auxiliary power supply units are configured to be switched between parallel connection and serial connection, wherein in a case where the temperature of the fixing member is no greater than the threshold fixation temperature, the auxiliary power supply controlling part switches the electric connection of the plural auxiliary power supply units to serial connection when an absolute value of the slope calculated by the calculating part is no less than a predetermined threshold slope and switches the electric connection of the plural auxiliary power supply units to parallel connection when the absolute value of the slope calculated by the calculating part is less than the predetermined threshold slope.

3. The image forming apparatus as claimed in claim 1, wherein the auxiliary power supply includes an electric double layer capacitor which is chargeable and dischargeable, wherein the electric double layer capacitor is charged when no power is being supplied from the main power supply to the main heating member.

4. The image forming apparatus as claimed in claim 1, further comprising:

a determining part for determining whether a predetermined condition is satisfied for fixing the toner image onto the recording medium by referring to the temperature detected by the temperature detecting part.

5. The image forming apparatus as claimed in claim 4, wherein the predetermined condition includes a toner fixation temperature which varies depending on the characteristic of the toner.

6. The image forming apparatus as claimed in claim 4, wherein the predetermined condition includes a fixation heat quantity which varies depending on the characteristic of the toner.

7. The image forming apparatus as claimed in claim 4, wherein the predetermined condition includes a total fixation heat quantity which varies depending on the characteristic of the recording medium.

8. The image forming apparatus as claimed in claim 4, wherein the predetermined condition includes at least one of a toner fixation temperature, a fixation heat quantity, and a total fixation heat quantity.

9. The image forming apparatus as claimed in claim 1, further comprising:

a control part configured to cause the main power supply, before beginning fixing the toner image onto the single medium, to supply electric power intermittently to the main heating member while the temperature detecting part detects that the temperature of the fixing member is at or above the threshold fixation temperature, the control part being further configured to cause the main power supply, before beginning fixing the toner image onto the single medium, to intermittently supply electric power to the auxiliary power supply while the temperature detecting part detects that the temperature of the fixing member is at or above the threshold fixation temperature such that, when the auxiliary power supply receives power from the main power supply, the main heating member does not receive power from the main power supply.

10. An image forming apparatus including a fixing apparatus for fixing a toner image onto a single recording medium by applying pressure and heat to toner provided on the surface of the recording medium, the fixing apparatus comprising:

a fixing member;

a pressing member configured to press against the fixing member;

a temperature detecting part configured to detect a temperature of the fixing member;

a heating member including a main heating member and an auxiliary heating member configured to heat the fixing member, the main heating member being connected to be heated by obtaining power from a main power supply, the auxiliary heating member being connected to be heated by obtaining power from an auxiliary power supply, wherein in a case where the temperature detecting part detects that the temperature of the fixing member being heated by the main heating member is no greater than a threshold fixation temperature, the heating member is configured to heat the auxiliary heating member when the toner image is in the middle of being fixed onto the single recording medium, wherein heating member is configured to heat the main heating member from before beginning heating the auxiliary heating member until after stopping heating the auxiliary heating member, and wherein the auxiliary power supply includes a fuel cell that can be reused by refueling.

11. The image forming apparatus as claimed in claim 10, wherein the fuel cell includes a part for detecting the amount of fuel remaining in the fuel cell, a part displaying the remaining amount of fuel, and a part for requesting the refueling of fuel when the remaining amount of fuel is below a predetermined value.

12. A fixing apparatus for fixing a toner image onto a single recording medium by applying pressure and heat to toner provided on the surface of the recording medium, the fixing apparatus comprising:

a fixing member;

a pressing member configured to press against the fixing member;

a temperature detecting part configured to detect a temperature of the fixing member;

a heating member including a main heating member and an auxiliary heating member configured to heat the fixing member, the main heating member being connected to be heated by obtaining power from a main power supply, the auxiliary heating member being connected to be heated by obtaining power from an auxiliary power supply, wherein in a case where the temperature detecting part detects that the temperature of the fixing member being heated by the main heating member is no greater than a threshold fixation temperature, the heating member is configured to heat the auxiliary heating member when the toner image is in the middle of being fixed onto the single recording medium, wherein heating member is configured to heat the main heating member from before beginning heating the auxiliary heating member until after stopping heating the auxiliary heating member, and wherein the heating member is configured to increase power supplied from the main power supply to the main heater immediately after completion of fixing the toner image onto the single recording medium.

* * * * *